US011105207B2

(12) United States Patent
Schrape et al.

(10) Patent No.: US 11,105,207 B2
(45) Date of Patent: Aug. 31, 2021

(54) WHEEL OF A FLUID FLOW MACHINE

(71) Applicants: Rolls-Royce Deutschland Ltd & Co KG, Blankenfelde-Mahlow (DE); Rolls-Royce plc, London (GB)

(72) Inventors: Sven Schrape, Rangsdorf (DE); Bernhard Mück, Berlin (DE); Jens Nipkau, Potsdam (DE); Thomas Giersch, Königs Wusterhausen (DE); Frank Heinichen, Berlin (DE); John Dodds, Derby (GB)

(73) Assignees: Rolls-Royce Deutschland Ltd & Co KG, Blankenfelde-Mahlow (DE); Rolls-Royce, London (GB)

( * ) Notice: Subject to any disclaimer, the term of this patent is extended or adjusted under 35 U.S.C. 154(b) by 163 days.

(21) Appl. No.: 16/539,688

(22) Filed: Aug. 13, 2019

(65) Prior Publication Data

US 2020/0056486 A1 Feb. 20, 2020

(30) Foreign Application Priority Data

Aug. 14, 2018 (DE) ..... 10 2018 119 704.7

(51) Int. Cl.
*F01D 5/14* (2006.01)

(52) U.S. Cl.
CPC ..... *F01D 5/141* (2013.01); *F05D 2240/10* (2013.01); *F05D 2240/24* (2013.01); *F05D 2250/38* (2013.01)

(58) Field of Classification Search
CPC .. F01D 5/141; F05D 2240/10; F05D 2250/38; F04D 29/666; F04D 29/544
See application file for complete search history.

(56) References Cited

U.S. PATENT DOCUMENTS 3,536,417 A 10/1970 Stiefel et al.
6,379,112 B1 4/2002 Montgomery
(Continued)

FOREIGN PATENT DOCUMENTS

DE 102013224081 A1 6/2015
EP 2623793 A1 8/2013
(Continued)

OTHER PUBLICATIONS

EP 2623793 Machine Translation (Year: 2012).*
(Continued)

*Primary Examiner* — Woody A Lee, Jr.
*Assistant Examiner* — Brian Christopher Delrue
(74) *Attorney, Agent, or Firm* — Timothy J. Klima; Shuttleworth & Ingersoll, PLC

(57) ABSTRACT

A blade wheel of a turbomachine, which blade wheel has a multiplicity of blades which are suitable and provided for extending radially in a flow path of the turbomachine, wherein the blades form a blade entry angle and a blade exit angle. Provision is made whereby the blade wheel forms N blocks of blades, where N≥2, wherein the blades of a block have in each case the same blade entry angle and the same blade exit angle, and the blades of at least two mutually adjacent blocks have a different blade entry angle and/or a different blade exit angle. According to a further aspect of the invention, partial gaps that the blades form in relation to an adjacent flow path boundary are varied in mutually adjacent blocks.

8 Claims, 11 Drawing Sheets

(56) References Cited

U.S. PATENT DOCUMENTS

| | | | | |
|---|---|---|---|---|
| 10,436,035 | B1 * | 10/2019 | Baralon | F01D 5/141 |
| 2004/0175260 | A1 | 9/2004 | Berthillier et al. | |
| 2013/0202444 | A1 | 8/2013 | Wunderer | |
| 2014/0286758 | A1 * | 9/2014 | Senn | F01D 9/041 415/160 |
| 2017/0114802 | A1 | 4/2017 | Passrucker et al. | |
| 2019/0162070 | A1 * | 5/2019 | Phelps | F02K 3/06 |
| 2020/0032816 | A1 * | 1/2020 | Heinichen | F01D 17/162 |

FOREIGN PATENT DOCUMENTS

| | | | |
|---|---|---|---|
| EP | 3382147 | A1 | 10/2018 |
| JP | 2013177816 | A | 9/2013 |

OTHER PUBLICATIONS

German Search Report dated May 13, 2019 for counterpart German Patent Application No. DE102018119704.7.

European Search Report dated Jan. 7, 2020 for counterpart European Patent Application No. 19190987.8.

* cited by examiner

WHEEL OF A FLUID FLOW MACHINE

This application claims priority to German Patent Application DE102018119704.7 filed Aug. 14, 2018, the entirety of which is incorporated by reference herein.

The invention relates to a blade wheel of a turbomachine as disclosed herein and to a blade wheel of a turbomachine as disclosed herein.

It is known that the blades of compressors of an engine are subject to non-synchronous oscillations. A phenomenon that arises here is known as "rotating stall", in the case of which separation patterns of the flow rotate in the reference system of the rotor. Here, it is the case that the separation process is locally limited to individual blade regions. This may involve one or more rotating separation patterns. The rotating separation patterns are commonly restricted to a limited radial blade region. The rotating separation disadvantageously excites oscillations or vibrations in the individual blades, thereby reducing the service life of the blades. Blade failure owing to resonance is also possible if the periodic excitations lie within the range of the natural oscillations of the blades. If a compressor is operated with rotating stall over a relatively long period of time, thermal damage to the blades may also occur.

The invention is based on the object of providing a blade wheel of a turbomachine, and a blade wheel arrangement, in the case of which the vibrations generated by rotating stall are reduced.

Said object is achieved by a blade wheel having features as disclosed herein and a blade wheel arrangement having features as disclosed herein Design embodiments of the invention are set forth in the dependent claims.

Accordingly, the invention relates to a blade wheel of a turbomachine, which blade wheel has a multiplicity of blades. The blades are suitable and provided for extending radially in a flow path of the turbomachine, and form a blade row. The blades form a blade entry angle and a blade exit angle.

According to a first aspect of the invention, provision is made whereby the blade wheel forms N blocks of blades, where $N \geq 2$, wherein the blades within a block have in each case the same blade entry angle and the same blade exit angle, and the blades of at least two mutually adjacent blocks have a different blade entry angle and/or a different blade exit angle. Here, the number N is a natural number.

Accordingly, the solution according to the invention is based on the concept of preventing or reducing the formation of rotating stall by introducing a varying aerodynamic load which acts on the blades. The blade wheel under consideration may in this case be a rotor with rotor blades or a stator with stator blades. As will be discussed further below, the invention also, in individual aspects, considers combinations of blade wheels.

The phenomenon of rotating stall is based on the occurrence of flow separation in individual blade ducts. Upstream of the blade channel that exhibits separation, the flow material builds up and is displaced to the side (in a circumferential direction and counter to the rotor rotation). In this way, the neighbouring blades are impinged on by flow with a steeper flow angle, and flow separation occurs here also. By means of the blocks of blades provided according to the invention, which have different blade entry angles and/or blade exit angles, the blades in the individual blocks are impinged on by flow at different angles, and/or the flow exits the blades of the individual blocks at different angles. It has been found that, in this way, the build-up of rotating cells is prevented, or such cells are weakened.

The blade wheel may have an even or odd number of blades. In the case of an even number of blades, provision may be made whereby in each case two adjacent blocks of blades have different blade entry angle and/or a different blade exit angle, and the angle variation thus alternates. In the case of an odd number of blades, provision may be made whereby no change in the blade entry angle and the blade exit angle occurs between two of the adjacent blocks, in order to allow for the odd number of blocks, but occurs between the other of the adjacent blocks. It is furthermore pointed out that, in one design embodiment, the blocks of the blade wheel form a total of two different blade entry angles and/or blade exit angles, and the alternating change in angle thus involves the same angle in each case.

One design embodiment of the invention provides for the blades of at least two mutually adjacent blocks to have a different blade entry angle and a different blade exit angle by virtue of the fact that the blades of the blocks, in the case of identical shaping of the blades, form a different stagger angle. The blades of adjacent blocks thus have a different stagger angle. Here, the blades, considered individually, all have the same shape. They are merely arranged in different blocks with a different stagger angle, wherein, for example, provision is made whereby the blocks realize two different stagger angles overall, which alternate.

An alternative design embodiment of the invention provides for the blades of at least two mutually adjacent blocks to have a different blade entry angle or a different blade exit angle by virtue of the fact that the blades of the blocks have a different shape. In this variant of the invention, the different angles are thus realized not by means of the stagger angle but by means of the shape of the blades. If the blade wheel is a rotor, it is in particular the case that the blade entry angle is different in adjacent blocks. If the blade wheel is a stator, it is in particular the case that the blade exit angle is different in adjacent blocks.

In one design embodiment, provision is made whereby the individual blocks have the same extent angle in a circumferential direction. The individual blocks thus have the same size and/or the same number of blades, wherein provision is however made whereby, in the case of an odd number of blades, one block has one blade more than the other blocks. Alternatively, provision may be made whereby at least two of the blocks have a different extent angle in a circumferential direction, wherein the blocks with different extent angle have a different number of blades. One design embodiment in this regard provides for all of the blocks to have a different extent angle in the circumferential direction and accordingly a different number of blades.

A further design embodiment provides for the blades of a block to be opened in relation to a nominal blade setting and for the blades of an adjacent block to be closed in relation to the nominal blade setting. Here, a nominal blade setting is one that the blades of the blade wheel would assume without the invention. The nominal blade setting constitutes, as it were, an imaginary initial position of the blade setting, from which the blades would be closed further or opened further depending on the block under consideration.

Provision may be made here whereby the blades of different blocks are opened and closed in one direction and in the other direction by the same degree of change proceeding from the nominal blade setting. However, this is not necessarily the case. The degree of change in one direction (for example "opening") need not imperatively correspond to the degree of change in the other direction. Also, in further design variants, provision may be made whereby the blade entry angle and/or the blade exit angle changes not in discrete fashion but in continuous fashion between adjacent blocks, for example in accordance with the shape of a sinusoidal curve.

One design variant of the invention provides that the first blade wheel has N blocks of blades and, for the stagger angle $\alpha_{S,i}$ of the i-th block (i), the following applies:

$$\alpha_{S,i}=\alpha_{S,0}+(-1)^i\Delta\alpha_S$$

where $\alpha_{S,0}$ is a constant and $1\leq i\leq N$. Here, the value $\alpha_{S,0}$ corresponds to a nominal setting, proceeding from which the blades of a block are adjusted either in one direction or in the other direction by the degree of change $\alpha_S$ in order to realize the stated angle.

The blade entry angle and/or the blade exit angle may also be varied in accordance with the same formula. Thus, in one design embodiment of the invention, if the blade wheel has N blocks of blades, the following applies for the blade entry angle and/or blade exit angle of the i-th block:

$$\gamma_i=\gamma_0+(-1)^i\Delta\gamma$$

where $\gamma_i$ is the blade entry angle or the blade exit angle, $\gamma_0$ and $\Delta\gamma$ are constants and $1\leq i\leq N$.

The angle $\Delta\alpha_S$ and/or the angle $\Delta\gamma$ has for example a value which lies in the range between 2° and 10°. The natural number N has for example a value which lies between 2 and 10. Here, it is for example the case that a very high value of the number N has the effect that the variations in the aerodynamic load are no longer perceptible at the blades, such that a very high value of the number N is not effective.

A further design embodiment provides that, for the angular position of the blades of the individual blocks, the following applies:

$$\varphi_l = \varphi_0 + \sum_{k=1}^{N} a_k \cos\left(\frac{2k\pi}{N} l\right) + b_k \sin\left(\frac{2k\pi}{N} l\right)$$

Here, the following applies:

- $\varphi$ is the blade entry angle, the blade exit angle or the stagger angle of the blades of a block under consideration;
- $a_k$, $b_k$ are freely selectable coefficients that lie in the range [−10°, 10° ];
- the index "l" denotes the number of the block under consideration;
- N denotes the total number of blocks, where N>2;
- the index "k" denotes the running index of the coefficients, where k=1, . . . , N;
- $\varphi_0$ is the mean angle that is set.

Here, for the coefficients $a_k$, $b_k$, it is the case that, for at least two values of the index "k", it is the case that not both coefficients $a_k$, $b_k$ are equal to zero. Thus, in the case of N equal to 3, it is for example the case that at least two of the coefficients $a_1$, $a_2$, $a_3$, $b_1$, $b_2$, $b_3$ are not equal to zero.

Through variation of the blade entry angle, of the blade exit angle or of the stagger angle of the blades of different blocks in accordance with the stated formula, patterns can be produced which do not have a common period over the circumference. In this way, the build-up of rotating cells can be prevented or weakened in an effective manner.

According to a further aspect of the invention, the invention relates to a blade wheel arrangement for a compressor of a turbomachine, which blade wheel arrangement has: a first blade wheel, which is formed as a rotor, a second blade wheel, which is arranged upstream of the first blade wheel and which is formed as a stator, and a third blade wheel, which is arranged downstream of the first blade wheel and which is formed as a stator. Here, provision is made whereby at least one of the blade wheels is formed as a blade wheel according to the present disclosure, and thus forms N blocks of blades, where N≥2, wherein the blades of a block have in each case the same blade entry angle and the same blade exit angle, and the blades of at least two mutually adjacent blocks have a different blade entry angle and/or a different blade exit angle.

Here, one design variant provides for the second blade wheel and the third blade wheel to be formed as blade wheels according to the present disclosure, wherein the two blade wheels form the same number of N blocks of blades, where N≥2. According to this design variant, the two stators of the considered sequence of stator-rotor -stator are thus designed in accordance with the present invention.

This has the effect that the rotor arranged between the two stators passes flow blocks with different angles of incidence during a rotation. In this way, changing aerodynamic and aeromechanical are loads exerted on the rotor. This prevents the development of rotating stall cells, because the development thereof requires a certain length of time over more than one rotation. An aerodynamic instability is generated, by means of which the vibration response of the rotor is changed, and oscillations are suppressed with greater intensity.

Here, the size of the blocks and the variation of blade entry angles and/or blade exit angles must be set such that the redistribution of flowing mass is great enough to prevent or considerably suppress the development of a separation pattern which is radially limited in its extent.

Here, one design embodiment provides that, for the stagger angle $\alpha_{S2,i}$ of the i-th block (i) of the second blade wheel and the stagger angle $\alpha_{S3,i}$ of the i-th block (i) of the third blade wheel, the following applies:

$$\alpha_{S2,i}=\alpha_{S2,0}+(-1)^i\Delta\alpha_{S2}$$

$$\alpha_{S3,i}=\alpha_{S3,0}-(-1)^i\Delta\alpha_{S3}$$

Here, $\alpha_{S2,0}$ and $\alpha_{S3,0}$ are constants, and $1\leq i\leq N$. Here, the two blade wheels have the same division into N blocks. The values $\alpha_{S2,0}$ and $\alpha_{S3,0}$ correspond in each case to a nominal setting, proceeding from which the blades of a block are adjusted either in one direction or in the other direction by the degree of change $\Delta\alpha_{S2}$ and $\Delta\alpha_{S3}$, respectively, in order to realize the stated angle.

It is in turn the case that the blade entry angle and/or the blade exit angle of the two blade wheels under consideration may also be varied in accordance with the same formulae.

A further embodiment of the invention provides for the first blade wheel, that is to say the rotor of the considered sequence of stator-rotor-stator, to be formed as a blade wheel according to the present disclosure.

In this variant of the invention, by means of the different angles of the rotor blades of different blocks, the formation of cells with rotating stall is excited to different degrees. Owing to this asymmetry, the formation of a coherent stall pattern with rotating cells is suppressed. Instead, excitation of the rotor blades occurs over a broad range, which however does not constitute a problem, because it leads to relatively low oscillation amplitudes.

Here, the size of the blocks and the variation of blade entry angles and/or blade exit angles must in turn be set such that the redistribution of flowing mass is great enough to prevent or considerably suppress the development of a separation pattern which is radially limited in its extent.

One design embodiment of the invention in this regard provides that the first blade wheel has N blocks of blades and, for the stagger angle $\alpha_{S,i}$ of the i-th block (i), the following applies:

$$\alpha_{S1,i}=\alpha_{S1,0}+(-1)^i\Delta\alpha_{S1}$$

where $\alpha_{S1,0}$ is a constant and $1\leq i\leq N$.

In further design embodiments of the invention, provision may be made whereby, in the considered arrangement of stator-rotor-stator, all of the blade wheels are designed in accordance with the present invention, or whereby only one of the stators is designed in accordance with the present invention. The variation of the stated angles may be realized, as discussed with regard to the single blade wheel, through variation of the stagger angle or through variation of the shaping of the blades of the individual blocks. Here, it is also possible for a variation of the stagger angle on one blade wheel to be combined with a variation of the shaping of the blades on another blade wheel.

A further design embodiment of the invention provides for the second blade wheel formed as a stator to be formed as an inlet stator. Compressors of aircraft engines are designed for a particular design rotational speed. In particular in the part-load range, that is to say at rotational speeds lower than the design rotational speed, there is the risk of local flow separation at the rotor blades of the compressor cascade. To reduce the risk of instances of stall in the part-load range, it is known for a stator with possibly adjustable stator blades to be arranged upstream of the first rotor of the compressor. Such a stator is referred to as an inlet stator or pre-stator or as IGV (IGV—"Inlet Guide Vane"). Inlet stators increase the swirl in the flow and improve the working range of a compressor.

However, the invention is in no way restricted to the blade row situated upstream being formed as an inlet stator. The blade row situated upstream may also be a normal stator of a compressor. The invention may be realized both in front stages and in stages which are embedded into a compressor.

In a further design embodiment, the second blade wheel has N blocks of blades, wherein at least two of the blocks have a different blade exit angle. Likewise, the third blade wheel has N blocks of blades, wherein at least two of the blocks have a different blade exit angle. Thus, in this design embodiment of the invention, the blade exit angle is varied in the case of the second and third blade wheels formed as stators. By contrast, in one design embodiment of the invention, the blade entry angle is varied in the case of the first blade wheel formed as a rotor.

However, variants are also possible in which the third blade wheel, which is formed as a stator and which is situated downstream, or the blade row formed by said third blade wheel, has only a change in the blade entry angle, whereas the second blade wheel, which is formed as a stator and which is situated upstream, has a change in the blade exit angle. This serves for adapting the angle of incidence to the circumferential variation caused by the blade wheel situated upstream. Here, the blade entry angle is increased in the region of the closed stator situated upstream, and is reduced in the region of the opened stator situated upstream.

A further design embodiment of the invention provides that a block or circumferential region of the second blade wheel, in which the blades of the block are closed to a greater degree in relation to a nominal blade setting, is assigned a block or circumferential region of the third blade wheel, in which the blades of the block are opened to a greater degree in relation to a nominal blade setting. The flow which has been subjected to relatively intense deflection in a block of the second blade wheel situated upstream is thus subjected to a lesser deflection in the corresponding block of the third blade wheel situated downstream, and vice versa.

A further aspect of the present invention concerns a blade wheel with a multiplicity of guide blades which extend in a flow path of the turbomachine, wherein the guide blades are each designed to be adjustable in terms of their stagger angle. The guide blades have first partial gaps to an outer flow path boundary and/or second partial gaps to an inner flow path boundary.

The radially inner flow path boundary is provided for example by a hub of the compressor, and the outer flow path boundary by a compressor casing. It is pointed out that the partial gaps are, owing to the rotatability of the guide blades, formed adjacent to the flow path boundary out of necessity, and the existence thereof permits a rotation or change in the stagger angle in the first place, because, without such partial gaps, contact or a collision with the flow path boundary would occur in the event of a change of the stagger angle. The gaps are referred to as partial gaps because they extend not over the entire axial length of the guide blades, but only over a partial length.

According to this aspect of the invention, provision is made whereby the blade wheel forms N blocks of blades, where $N\geq 2$, wherein the blades of a block have in each case identically formed partial gaps and the blades of at least two mutually adjacent blocks have differently formed partial gaps.

This aspect of the invention is likewise based on the concept of preventing or reducing the formation of rotating stall by introducing a varying aerodynamic load which acts on the blades. By means of the blocks of blades provided according to the invention, which form different partial gaps to the flow path boundary, the flow in the individual blocks is varied.

Here, the partial gaps are formed differently in the different blocks. In particular, there is an axial and/or radial variation of the partial gaps. Provision may be made here whereby the blade wheel implements a total of two different design embodiments of the partial gaps, which the blocks of the blade wheel realize in alternating fashion.

The further aspect of the invention, which provides a variation of the partial gaps in adjacent blocks, may be combined with the above-described aspect of the invention, which provides a variation of the blade entry angle and/or of the blade exit angle in adjacent blocks.

One design embodiment provides for the blades of at least two mutually adjacent blocks to have partial gaps which have a different axial length. A variation of the partial gaps in different blocks is thus realized by means of the axial length of the partial gaps. Such a variation may be achieved for example through variation of the diameter of rotary plates which the guide blades form at their radially outer end and/or at their radially inner end and which permit the rotatability of said guide blades.

A further design embodiment provides for the blades of at least two mutually adjacent blocks to have partial gaps which have a different radial height. A variation of the partial gaps in different blocks is thus realized by means of the radial height of the partial gaps. Such a variation may be realized by means of the radial depth of cut-backs which are formed on the guide blades in the region of the leading edge and/or in the region of the trailing edge and, here, radially adjacent to the respective flow path boundary.

A further design embodiment provides for the blades of at least two mutually adjacent blocks to have partial gaps which have different axial length and a different radial height, and the variations of the partial gaps discussed above are thus combined.

In one design embodiment, the partial gaps are formed by cut-backs that the guide blades form in relation to the adjacent flow path boundary.

By means of the length and height of the partial gaps, a gap volume of the partial gap is defined. The partial gaps of the blades of adjacent blocks have a different gap volume.

According to a further aspect of the invention, the invention relates to a blade wheel arrangement for a compressor of a turbomachine, which blade wheel arrangement has: a first blade wheel, which is formed as a rotor, a second blade wheel, which is arranged upstream of the first blade wheel and which is formed as a stator, and a third blade wheel, which is arranged downstream of the first blade wheel and which is formed as a stator. Provision is made here whereby the second blade wheel and/or the third blade wheel are formed as a blade wheel according to the present disclosure.

One design variant of the blade wheel arrangement provides for the second blade wheel and the third blade wheel to be formed as blade wheels according to the present disclosure, wherein the two blade wheels form the same number of N blocks of blades, where $N \geq 2$.

A further design embodiment provides that the second blade wheel is formed as an inlet stator, and a block of the second blade wheel, in which the gap volume of the partial gaps is relatively large, is assigned a block of the third blade wheel, in which the gap volume of the partial gaps is relatively small, and vice versa. The flow which has been subjected to relatively intense disruption in a block of the inlet stator situated upstream, owing to the relatively large partial gap, is thus subjected to a lesser disruption in the corresponding block of the third blade wheel situated downstream, owing to the relatively small partial gap, and vice versa. Here, the terms "relatively large" and "relatively small" relate in each case to the gap volume of the adjacent block of the blade wheel under consideration.

According to a further design embodiment, the blade wheel arrangement is embedded into a compressor, wherein the second blade wheel is formed as an embedded stator (and not as an inlet stator). Provision is made here whereby a block of the second blade wheel, in which the gap volume of the partial gaps is relatively small, is assigned a block of the third blade wheel, in which the gap volume of the partial gaps is likewise relatively small, and a block of the second blade wheel, in which the gap volume of the partial gaps is relatively large, is assigned a block of the third blade wheel, in which the gap volume of the partial gaps is likewise relatively large. The flow which has been subjected to relatively intense disruption in a block of the blade wheel situated upstream, owing to a relatively large partial gap, is thus likewise subjected to a more intense disruption in the corresponding block of the third blade wheel situated downstream, owing to the likewise relatively large partial gap, than in the blocks with relatively small partial gaps. Again, the terms "relatively large" and "relatively small" relate in each case to the gap volume of the adjacent block of the blade wheel under consideration.

In a further aspect of the invention, the invention relates to a gas turbine engine, in particular for an aircraft, having a blade wheel arrangement according to the invention. Provision may be made here whereby the gas turbine engine has:

an engine core which comprises a turbine, a compressor having a blade wheel arrangement according to the invention, and a turbine shaft connecting the turbine to the compressor and formed as a hollow shaft;

a fan which is positioned upstream of the engine core, wherein the fan comprises a plurality of fan blades; and a gearbox that receives an input from the turbine shaft and outputs drive to the fan so as to drive the fan at a lower rotational speed than the turbine shaft.

One design embodiment in this regard may provide that the turbine is a first turbine, the compressor is a first compressor, and the turbine shaft is a first turbine shaft;

the engine core further comprises a second turbine, a second compressor, and a second turbine shaft which connects the second turbine to the second compressor; and the second turbine, the second compressor, and the second turbine shaft are arranged so as to rotate at a higher rotational speed than the first turbine shaft.

It is pointed out that the present invention, to the extent that the latter relates to an aircraft gas turbine, is described with reference to a cylindrical coordinate system which has the coordinates x, r, and φ. Here, x indicates the axial direction, r indicates the radial direction, and φ indicates the angle in the circumferential direction. The axial direction is in this case identical to the machine axis of a gas turbine engine in which the blade wheel or the blade wheel arrangement is arranged. Proceeding from the x-axis, the radial direction points radially outward. Terms such as "in front of", "behind", "front", and "rear" refer to the axial direction, or the flow direction in the engine in which the planetary gearbox is arranged, respectively. Terms such as "outer" or "inner" refer to the radial direction.

As noted elsewhere herein, the present disclosure may relate to a gas turbine engine. Such a gas turbine engine may comprise an engine core which comprises a turbine, a combustion chamber, a compressor, and a core shaft that connects the turbine to the compressor. Such a gas turbine engine may comprise a fan (having fan blades) which is positioned upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be performed directly from the core shaft or indirectly from the core shaft, for example via a spur shaft and/or a spur gear. The core shaft may be rigidly connected to the turbine and the compressor, such that the turbine and the compressor rotate at the same rotational speed (wherein the fan rotates at a lower rotational speed).

The gas turbine engine as described and/or claimed herein may have any suitable general architecture. For example, the gas turbine engine may have any desired number of shafts, for example one, two or three shafts, that connect turbines and compressors. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft which connects the second turbine to the second compressor. The second turbine, the second compressor, and the second core shaft may be arranged so as to rotate at a higher rotational speed than the first core shaft.

In such an arrangement, the second compressor may be positioned so as to be axially downstream of the first compressor. The second compressor may be arranged so as to receive (for example directly receive, for example via a generally annular duct) flow from the first compressor.

The gearbox may be arranged so as to be driven by the core shaft (for example the first core shaft in the example above) that is configured to rotate (for example during use) at the lowest rotational speed. For example, the gearbox may be arranged so as to be driven only by the core shaft (for example only by the first core shaft, and not the second core shaft, in the example above) that is configured to rotate (for example during use) at the lowest rotational speed. Alternatively thereto, the gearbox may be arranged so as to be driven by one or a plurality of shafts, for example the first and/or the second shaft in the example above.

In the case of a gas turbine engine as described and/or claimed herein, a combustion chamber may be provided axially downstream of the fan and of the compressor(s). For example, the combustion chamber may lie directly downstream of the second compressor (for example at the exit of the latter), when a second compressor is provided. By way of a further example, the flow at the exit of the compressor may be fed to the inlet of the second turbine, when a second turbine is provided. The combustion chamber may be provided upstream of the turbine(s).

The or each compressor (for example the first compressor and the second compressor as described above) may comprise any number of stages, for example multiple stages. Each stage may comprise a row of rotor blades and a row of stator blades, which may be variable stator blades (in the sense that the angle of incidence of said variable stator blades may be variable). The row of rotor blades and the row of stator blades may be axially offset from one another.

The or each turbine (for example the first turbine and the second turbine as described above) may comprise any number of stages, for example multiple stages. Each stage may comprise a row of rotor blades and a row of stator blades. The row of rotor blades and the row of stator blades may be axially offset from one another.

Each fan blade can be defined as having a radial span extending from a root (or a hub) at a radially inner location flowed over by gas, or at a 0% span width position, to a tip at a 100% span width position. The ratio of the radius of the fan blade at the hub to the radius of the fan blade at the tip may be less than (or of the order of magnitude of): 0.4, 0.39, 0.38, 0.37, 0.36, 0.35, 0.34, 0.33, 0.32, 0.31, 0.3, 0.29, 0.28, 0.27, 0.26 or 0.25. The ratio of the radius of the fan blade at the hub to the radius of the fan blade at the tip may be in an inclusive range delimited by two of the values in the previous sentence (that is to say that the values may form upper or lower limits). These ratios can commonly be referred to as the hub-to-tip ratio. The radius at the hub and the radius at the tip can both be measured at the leading periphery (or the axially frontmost periphery) of the blade. The hub-to-tip ratio refers, of course, to that portion of the fan blade which is flowed over by gas, that is to say the portion that is situated radially outside any platform.

The radius of the fan can be measured between the engine centerline and the tip of the fan blade at the leading periphery of the latter. The diameter of the fan (which may simply be double the radius of the fan) may be larger than (or of the order of magnitude of): 250 cm (approximately 100 inches), 260 cm, 270 cm (approximately 105 inches), 280 cm (approximately 110 inches), 290 cm (approximately 115 inches), 300 cm (approximately 120 inches), 310 cm, 320 cm (approximately 125 inches), 330 cm (approximately 130 inches), 340 cm (approximately 135 inches), 350 cm, 360 cm (approximately 140 inches), 370 cm (approximately 145 inches), 380 cm (approximately 150 inches), or 390 cm (approximately 155 inches). The fan diameter may be in an inclusive range delimited by two of the values in the previous sentence (that is to say that the values may form upper or lower limits).

The rotational speed of the fan may vary during use. Generally, the rotational speed is lower for fans with a comparatively large diameter. Purely by way of non-limiting example, the rotational speed of the fan under constant-speed conditions may be less than 2500 rpm, for example less than 2300 rpm. Purely by way of further non-limiting example, the rotational speed of the fan under constant-speed conditions for an engine having a fan diameter in the range from 250 cm to 300 cm (for example 250 cm to 280 cm) may also be in the range from 1700 rpm to 2500 rpm, for example in the range from 1800 rpm to 2300 rpm, for example in the range from 1900 rpm to 2100 rpm. Purely by way of further non-limiting example, the rotational speed of the fan under constant-speed conditions for an engine having a fan diameter in the range from 320 cm to 380 cm may be in the range from 1200 rpm to 2000 rpm, for example in the range from 1300 rpm to 1800 rpm, for example in the range from 1400 rpm to 1600 rpm.

During use of the gas turbine engine, the fan (with associated fan blades) rotates about an axis of rotation. This rotation results in the tip of the fan blade moving with a speed $U_{tip}$. The work done by the fan blades on the flow results in an enthalpy rise dH in the flow. A fan tip loading can be defined as $dH/U_{tip}^2$, where dH is the enthalpy rise (for example the 1-D average enthalpy rise) across the fan and $U_{tip}$ is the (translational) speed of the fan tip, for example at the leading periphery of the tip (which can be defined as the fan tip radius at the leading periphery multiplied by the angular speed). The fan tip loading under constant-speed conditions may be more than (or of the order of magnitude of): 0.3, 0.31, 0.32, 0.33, 0.34, 0.35, 0.36, 0.37, 0.38, 0.39, or 0.4 (wherein all units in this passage are $Jkg^{-1}K^{-1}/(ms^{-1})^2$). The fan tip loading may be in an inclusive range delimited by two of the values in the previous sentence (that is to say that the values may form upper or lower limits).

Gas turbine engines in accordance with the present disclosure may have any desired bypass ratio, wherein the bypass ratio is defined as the ratio of the mass flow rate of the flow through the bypass duct to the mass flow rate of the flow through the core under constant-speed conditions. In the case of some arrangements, the bypass ratio may be more than (or of the order of magnitude of): 10, 10.5, 11, 11.5, 12, 12.5, 13, 13.5, 14, 14.5, 15, 15.5, 16, 16.5, or 17. The bypass ratio may be in an inclusive range delimited by two of the values in the previous sentence (that is to say that the values may form upper or lower limits). The bypass duct may be substantially annular. The bypass duct may be situated radially outside the engine core. The radially outer surface of the bypass duct may be defined by an engine nacelle and/or a fan casing.

The overall pressure ratio of a gas turbine engine as described and/or claimed herein can be defined as the ratio of the stagnation pressure upstream of the fan to the stagnation pressure at the exit of the highest pressure compressor (before entry into the combustion chamber). By way of a non-limiting example, the overall pressure ratio of a gas turbine engine as described and/or claimed herein at constant speed may be greater than (or of the order of magnitude of): 35, 40, 45, 50, 55, 60, 65, 70, 75. The overall pressure ratio may be in an inclusive range delimited by two of the values in the previous sentence (that is to say that the values may form upper or lower limits).

The specific thrust of an engine can be defined as the net thrust of the engine divided by the total mass flow through the engine. The specific thrust of an engine as described and/or claimed herein under constant-speed conditions may be less than (or of the order of magnitude of): 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}s$ or 80 $Nkg^{-1}s$. The specific thrust may be in an inclusive range delimited by two of the values in the previous sentence (that is to say that the values may form upper or lower limits). Such engines can be particularly efficient in comparison with conventional gas turbine engines.

A gas turbine engine as described and/or claimed herein may have any desired maximum thrust. Purely by way of a non-limiting example, a gas turbine as described and/or claimed herein may be capable of generating a maximum thrust of at least (or of the order of magnitude of): 160 kN, 170 kN, 180 kN, 190 kN, 200 kN, 250 kN, 300 kN, 350 kN, 400 kN, 450 kN, 500 kN, or 550 kN. The maximum thrust may be in an inclusive range delimited by two of the values in the previous sentence (that is to say that the values may form upper or lower limits). The thrust referred to above may be the maximum net thrust at standard atmospheric conditions at sea level plus 15 degrees C. (ambient pressure 101.3 kPa, temperature 30 degrees C.) in the case of a static engine.

In use, the temperature of the flow at the entry to the high pressure turbine can be particularly high. This temperature, which can be referred to as TET, may be measured at the exit to the combustion chamber, for example directly upstream of the first turbine blade, which in turn can be referred to as a nozzle guide blade. At constant speed, the TET may be at least (or of the order of magnitude of): 1400K, 1450K, 1500K, 1550K, 1600K, or 1650K. The TET at constant speed may be in an inclusive range delimited by two of the values in the previous sentence (that is to say that the values may form upper or lower limits). The maximum TET in the use of the engine may be at least (or of the order of magnitude of), for example: 1700K, 1750K, 1800K, 1850K, 1900K, 1950K, or 2000K. The maximum TET may be in an inclusive range delimited by two of the values in the previous sentence (that is to say that the values may form upper or lower limits). The maximum TET may occur, for example, under a high thrust condition, for example under a maximum take-off thrust (MTO) condition.

A fan blade and/or an airfoil portion of a fan blade described and/or claimed herein may be manufactured from any suitable material or a combination of materials. For example, at least a part of the fan blade and/or of the airfoil may be manufactured at least in part from a composite, for example a metal matrix composite and/or an organic matrix composite, such as carbon fiber. By way of further example, at least a part of the fan blade and/or of the airfoil may be manufactured at least in part from a metal, such as a titanium-based metal or an aluminum-based material (such as an aluminum-lithium alloy) or a steel-based material. The fan blade may comprise at least two regions which are manufactured using different materials. For example, the fan blade may have a protective leading periphery, which is manufactured using a material that is better able to resist impact (for example of birds, ice, or other material) than the rest of the blade. Such a leading periphery may, for example, be manufactured using titanium or a titanium-based alloy. Thus, purely by way of example, the fan blade may have a carbon-fiber-based or aluminum-based body (such as an aluminum-lithium alloy) with a titanium leading periphery.

A fan as described and/or claimed herein may comprise a central portion, from which the fan blades may extend, for example in a radial direction. The fan blades may be attached to the central portion in any desired manner. For example, each fan blade may comprise a fixing device which can engage with a corresponding slot in the hub (or disk). Purely by way of example, such a fixing device may be in the form of a dovetail that can be inserted into and/or engage with a corresponding slot in the hub/disk in order for the fan blade to be fixed to the hub/disk. By way of further example, the fan blades may be formed integrally with a central portion. Such an arrangement can be referred to as a blisk or a bling. Any suitable method may be used to manufacture such a blisk or such a bling. For example, at least a part of the fan blades may be machined from a block and/or at least a part of the fan blades may be attached to the hub/disk by welding, such as linear friction welding, for example.

The gas turbine engines described and/or claimed herein may or may not be provided with a variable area nozzle (VAN). Such a variable area nozzle can allow the exit cross section of the bypass duct to be varied during use. The general principles of the present disclosure can apply to engines with or without a VAN.

The fan of a gas turbine as described and/or claimed herein may have any desired number of fan blades, for example 16, 18, 20, or 22 fan blades.

As used herein, constant-speed conditions can mean constant-speed conditions of an aircraft to which the gas turbine engine is attached. Such constant-speed conditions can be conventionally defined as the conditions during the middle part of the flight, for example the conditions experienced by the aircraft and/or the engine between (in terms of time and/or distance) the end of an ascent and the start of a descent.

Purely by way of example, the forward speed under the constant-speed condition can be any point in the range of from Mach 0.7 to 0.9, for example 0.75 to 0.85, for example 0.76 to 0.84, for example 0.77 to 0.83, for example 0.78 to 0.82, for example 0.79 to 0.81, for example of the order of magnitude of Mach 0.8, of the order of magnitude of Mach 0.85 or in the range of from 0.8 to 0.85. Any arbitrary speed within these ranges can be the constant cruise condition. In the case of some aircraft, the constant cruise conditions may be outside these ranges, for example below Mach 0.7 or above Mach 0.9.

Purely by way of example, the constant-speed conditions may correspond to standard atmospheric conditions at an altitude that is in the range from 10,000 m to 15,000 m, for example in the range from 10,000 m to 12,000 m, for example in the range from 10,400 m to 11,600 m (around 38,000 ft), for example in the range from 10,500 m to 11,500 m, for example in the range from 10,600 m to 11,400 m, for example in the range from 10,700 m (around 35,000 ft) to 11,300 m, for example in the range from 10,800 m to 11,200 m, for example in the range from 10,900 m to 11,100 m, for example in the region of 11,000 m. The constant-speed conditions may correspond to standard atmospheric conditions at any given altitude in these ranges.

Purely by way of example, the constant-speed conditions may correspond to the following: a forward Mach number of 0.8; a pressure of 23,000 Pa; and a temperature of −55 degrees C.

As used anywhere herein, "constant speed" or "constant-speed conditions" can mean the aerodynamic design point. Such an aerodynamic design point (or ADP) may correspond to the conditions (including, for example, the Mach number, environmental conditions, and thrust requirement) for which the fan operation is designed. This may mean, for example, the conditions under which the fan (or the gas turbine engine) has the optimum efficiency in terms of construction.

During use, a gas turbine engine described and/or claimed herein may operate at the constant-speed conditions defined elsewhere herein. Such constant-speed conditions may be determined by the constant-speed conditions (for example the conditions during the middle part of the flight) of an aircraft to which at least one (for example 2 or 4) gas turbine engine(s) can be fastened in order to provide the thrust force.

It is self-evident to a person skilled in the art that a feature or parameter described in relation to any one of the above aspects may be applied to any other aspect, unless they are mutually exclusive. Furthermore, any feature or any parameter described here may be applied to any aspect and/or combined with any other feature or parameter described here, unless they are mutually exclusive.

The invention will be explained in more detail hereunder by means of a plurality of exemplary embodiments with reference to the figures of the drawing. In the drawing.

Figure 5:
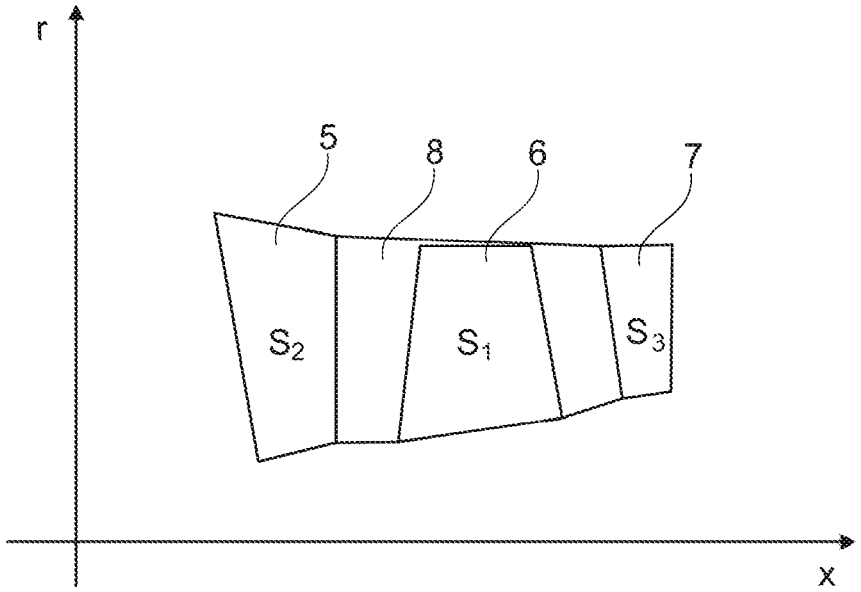
Figure 6:
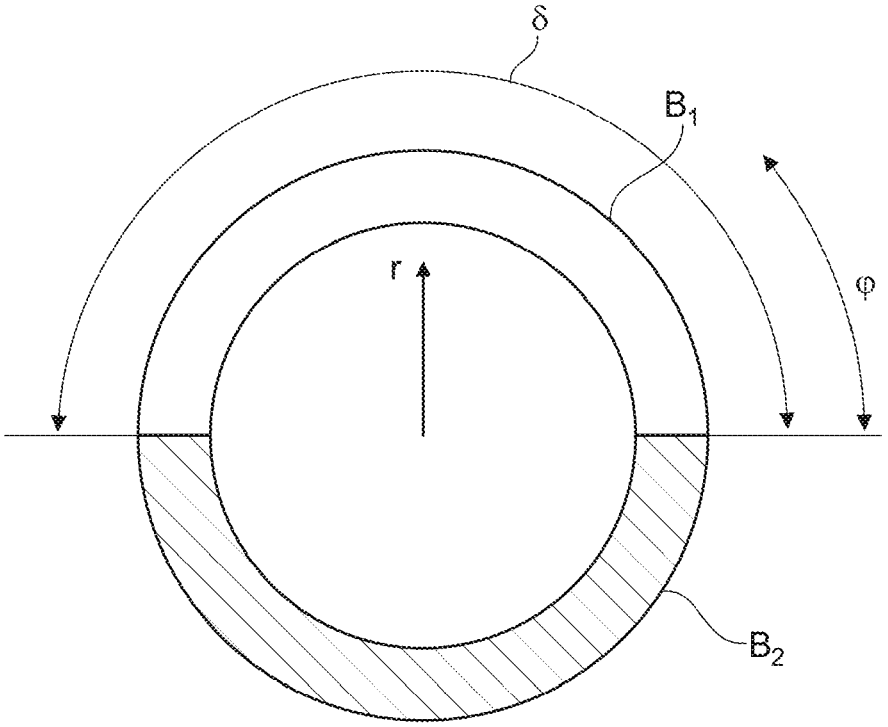
Figure 7:
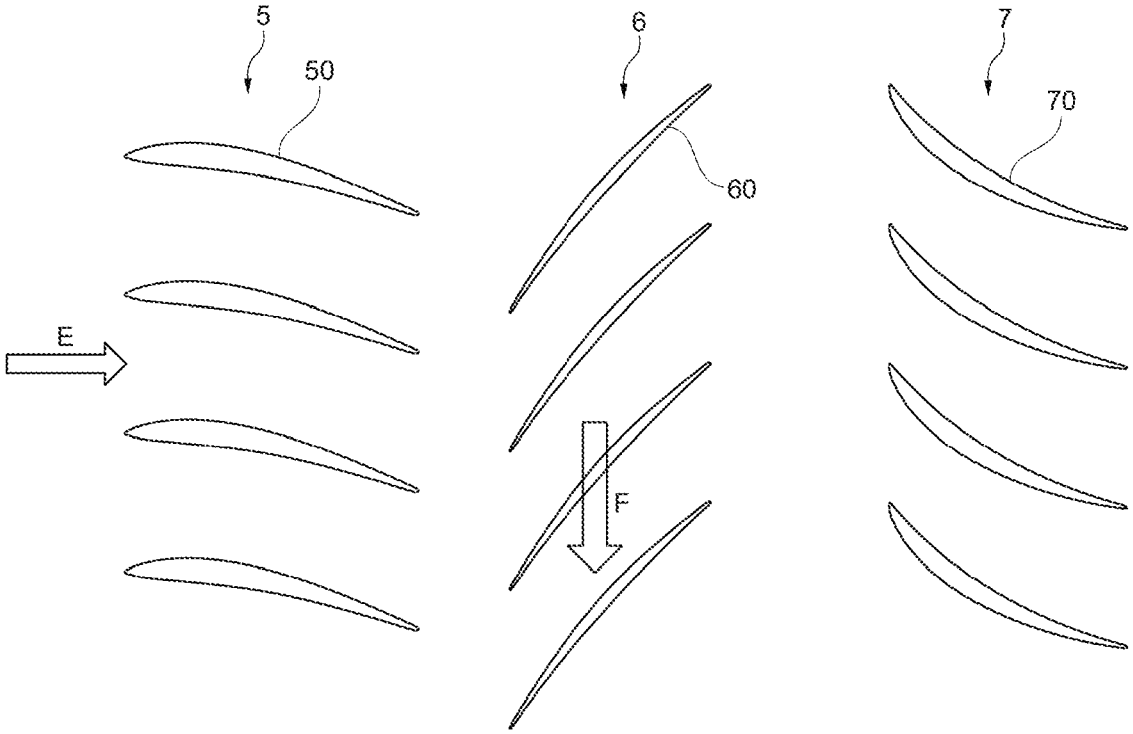
Figure 8:
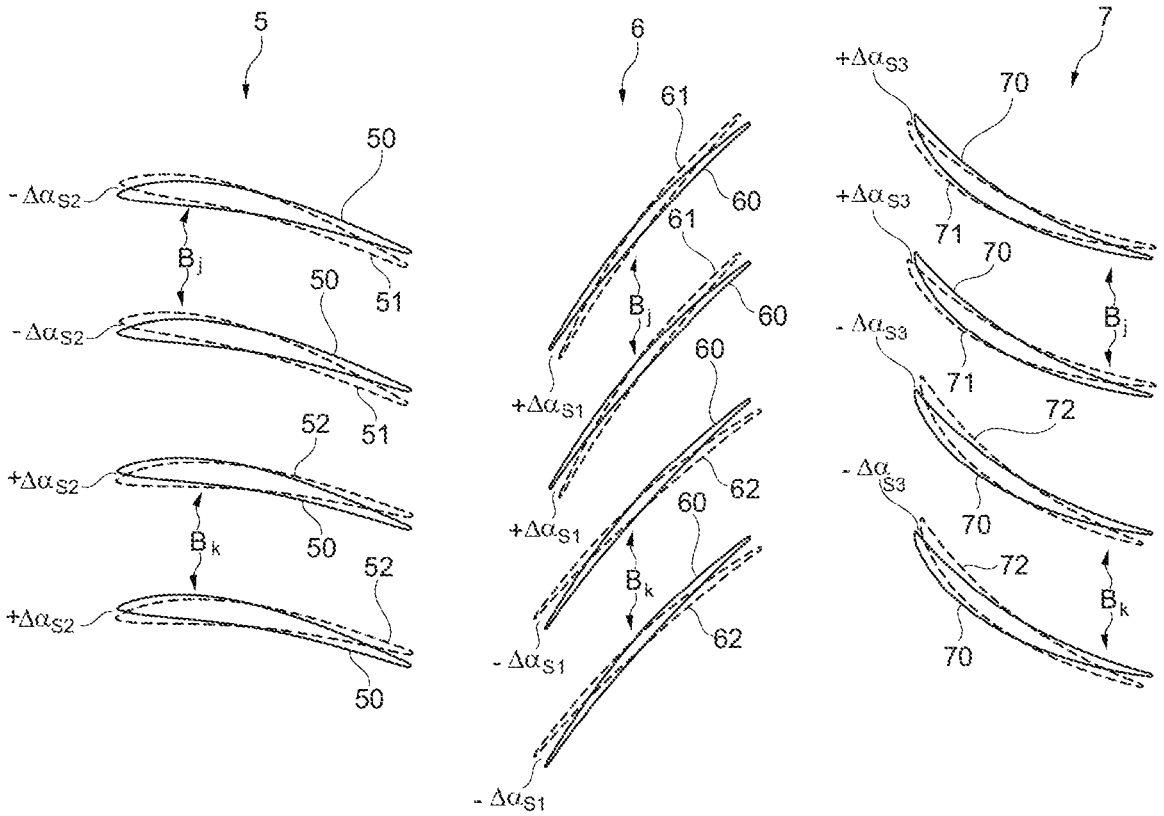
Figure 9:
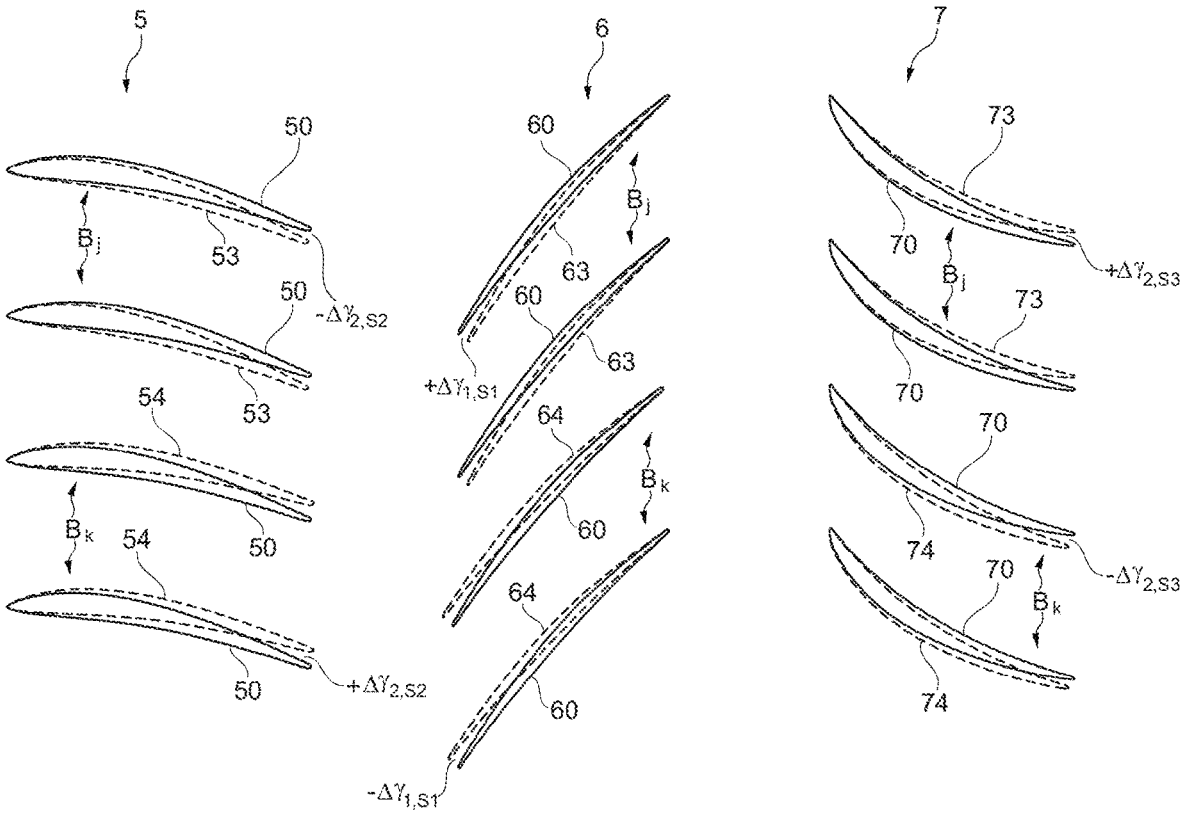
Figure 10:
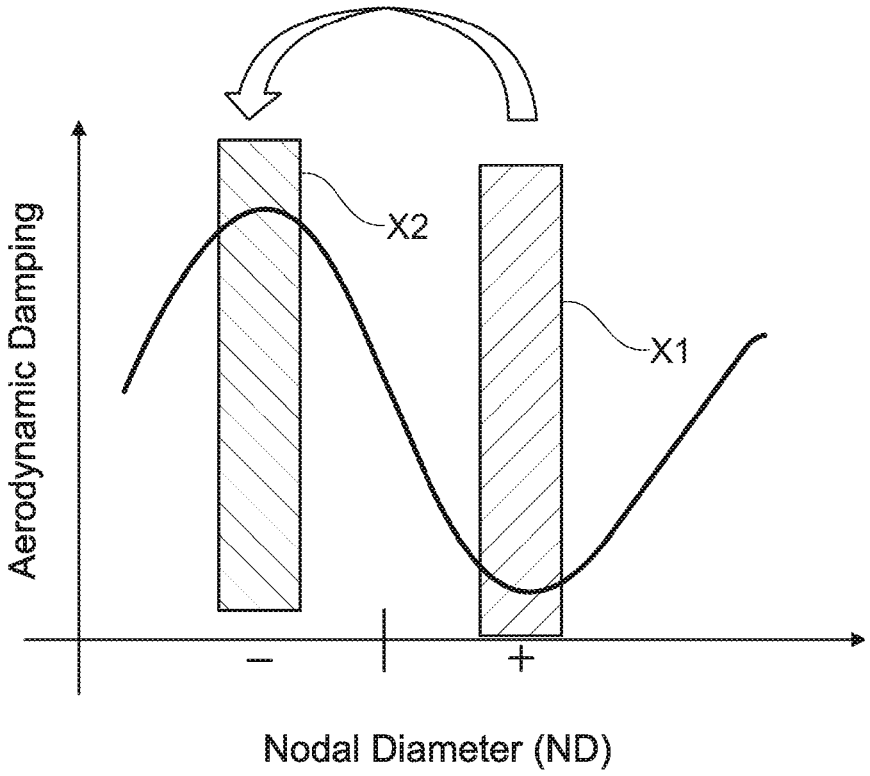
Figure 11:
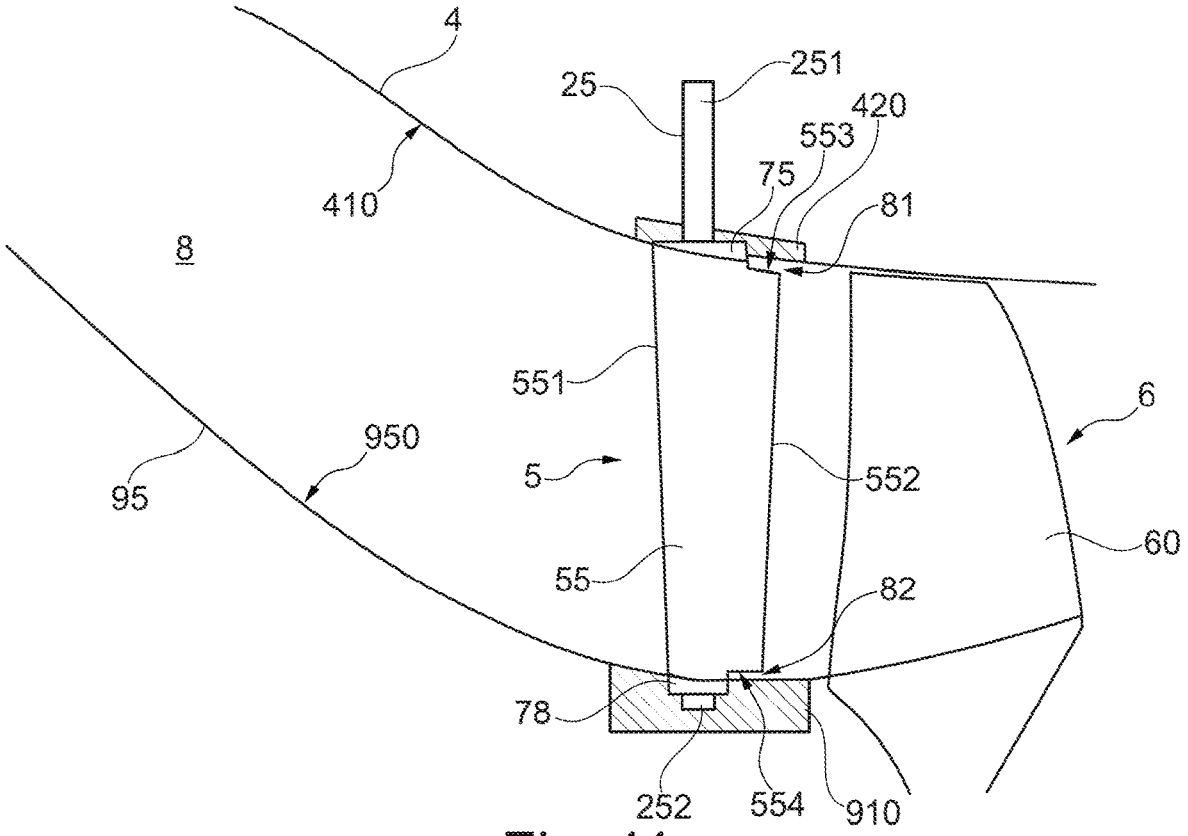
Figure 12:
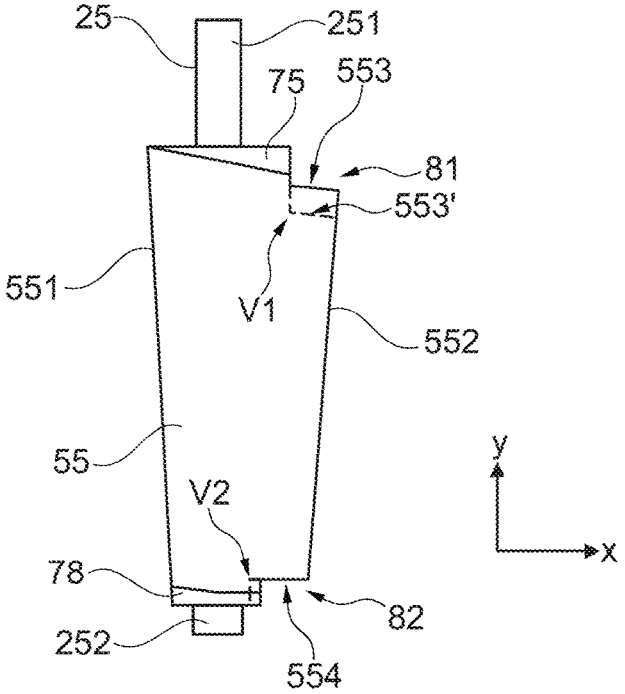
Figure 13:
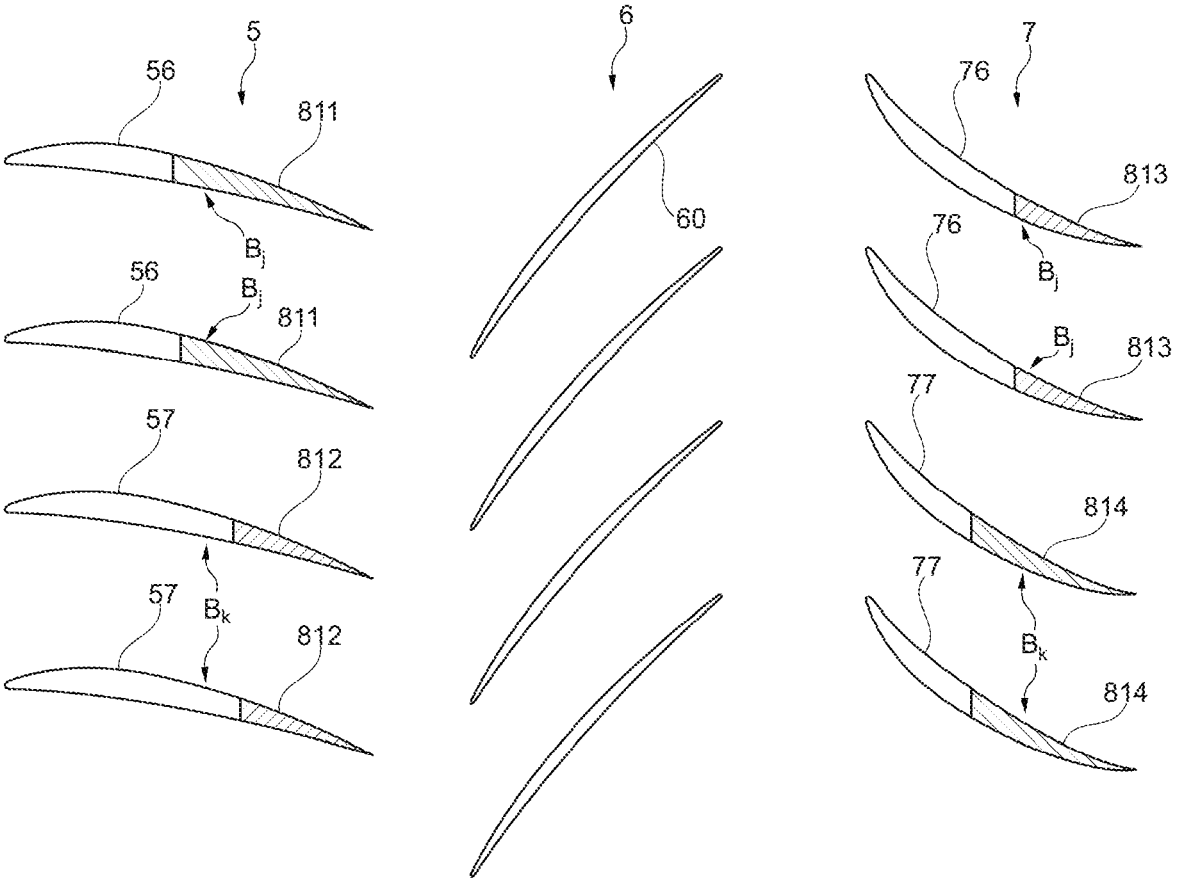
Figure 14:
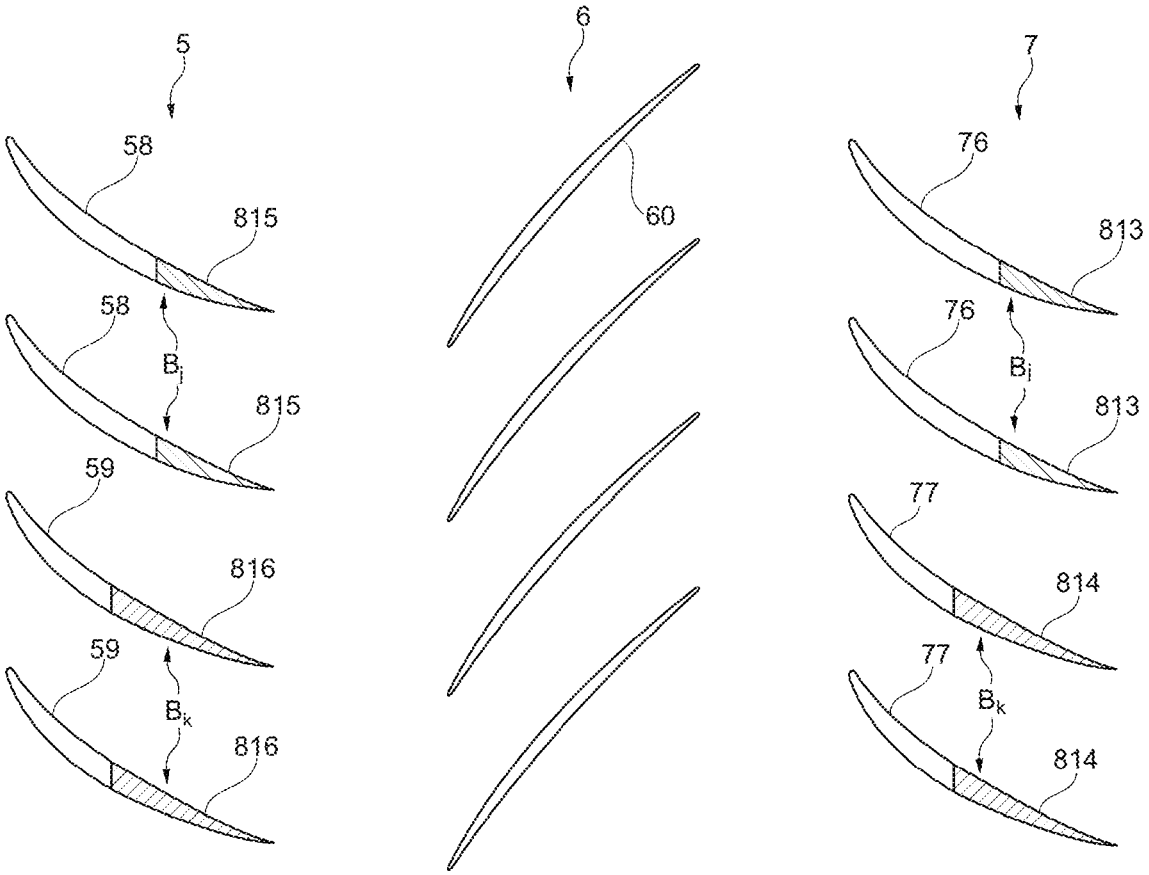

FIG. 5 schematically shows, in an axial sectional illustration, a blade arrangement of a compressor of a gas turbine engine having upstream stator, a rotor and a downstream stator;

FIG. 6 schematically shows a section through the blade wheel of a rotor or of a stator according to FIG. 5 in a plane perpendicular to the machine axis, wherein the blade wheel comprises two regions which have a different blade entry angle and/or blade exit angle;

FIG. 7 shows a blade wheel arrangement according to FIG. 5, wherein the blades of the individual blade wheels are each formed as nominal blades;

FIG. 8 shows a blade wheel arrangement according to FIG. 5, in which the blades of all three blade wheels form blocks which form a different blade stagger angle;

FIG. 9 shows a blade wheel arrangement according to FIG. 5, in which the blades of all three blade wheels form blocks which have a different blade entry angle or blade exit angle; and FIG. 10 shows a schematic illustration of the advantages attained with the invention, illustrating the aerodynamic damping in a manner depending on the nodal diameter, wherein, in the case of a blade wheel arrangement according to the invention, the blades are excited so as to perform oscillations, which are subjected to relatively intense damping;

FIG. 11 schematically shows a structural subassembly which has an inlet stator with adjustable stagger angle and partial gaps to the adjacent flow path boundaries;

FIG. 12 shows an inlet stator according to FIG. 11 with partial gaps formed thereon;

FIG. 13 shows, in a cascade illustration, an exemplary embodiment of a blade wheel arrangement having an upstream inlet stator, a rotor and a downstream stator, wherein the blades of the inlet stator and of the stator are arranged in each case in blocks which have differently formed partial gaps; and FIG. 14 shows, in a cascade illustration, an exemplary embodiment of a blade wheel arrangement embedded into a compressor, having an upstream stator, a rotor and a downstream stator, wherein the blades of the two stators are arranged in each case in blocks which have differently formed partial gaps.

Figure 1:
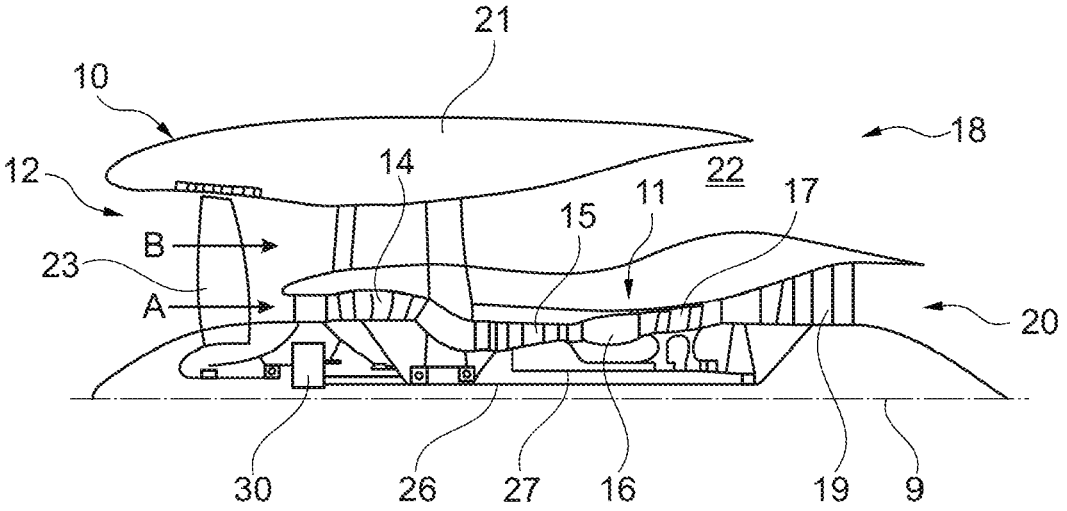
FIG. 1 shows a sectional lateral view of a gas turbine engine.

FIG. 1 illustrates a gas turbine engine 10 having a main axis of rotation 9. The engine 10 comprises an air intake 12 and a thrust fan 23 that generates two air flows: a core air flow A and a bypass air flow B. The gas turbine engine 10 comprises a core 11 which receives the core air flow A. In the sequence of axial flow, the engine core 11 comprises a low-pressure compressor 14, a high-pressure compressor 15, a combustion device 16, a high-pressure turbine 17, a low-pressure turbine 19, and a core thrust nozzle 20. An engine nacelle 21 surrounds the gas turbine engine 10 and defines a bypass duct 22 and a bypass thrust nozzle 18. The bypass air flow B flows through the bypass duct 22. The fan 23 is attached to and driven by the low-pressure turbine 19 by way of a shaft 26 and an epicyclic gearbox 30.

During use, the core air flow A is accelerated and compressed by the low-pressure compressor 14 and directed into the high-pressure compressor 15, where further compression takes place. The compressed air expelled from the high-pressure compressor 15 is directed into the combustion device 16, where it is mixed with fuel and the mixture is combusted. The resultant hot combustion products then expand through, and thereby drive, the high-pressure and low-pressure turbines 17, 19 before being expelled through the nozzle 20 to provide some propulsive thrust. The high-pressure turbine 17 drives the high-pressure compressor 15 by means of a suitable connecting shaft 27. The fan 23 generally provides the major part of the thrust force. The epicyclic gearbox 30 is a reduction gearbox.

Figure 2:
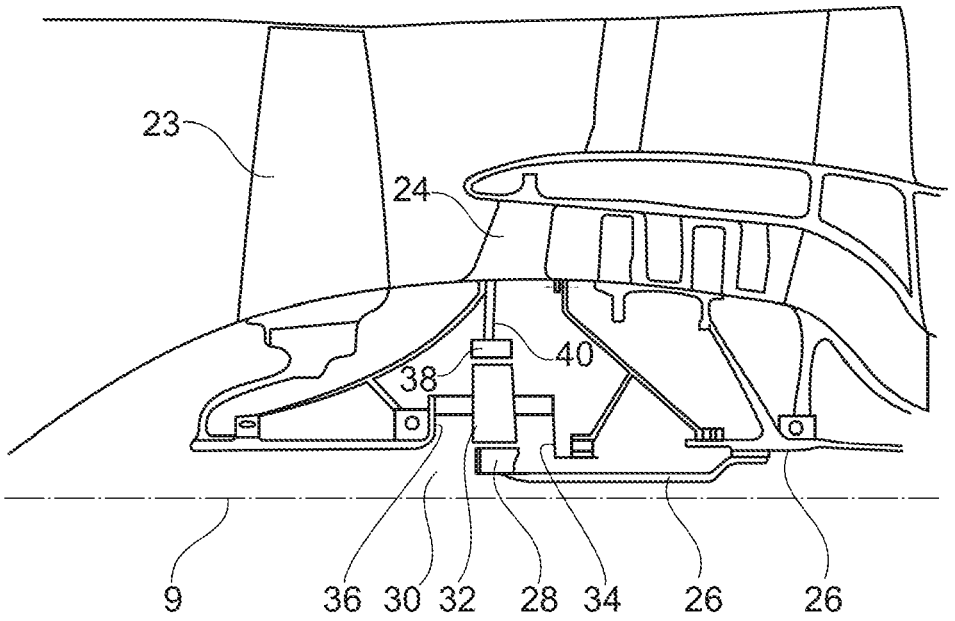
FIG. 2 shows a close-up sectional lateral view of an upstream portion of a gas turbine engine.

An exemplary arrangement for a gearbox fan gas turbine engine 10 is shown in FIG. 2. The low-pressure turbine 19 (see FIG. 1) drives the shaft 26, which is coupled to a sun gear 28 of the epicyclic gearbox assembly 30. Radially to the outside of the sun gear 28 and meshing therewith are a plurality of planet gears 32 that are coupled to one another by a planet carrier 34. The planet carrier 34 limits the planet gears 32 to orbiting around the sun gear 28 in a synchronous manner whilst enabling each planet gear 32 to rotate about its own axis. The planet carrier 34 is coupled by way of linkages 36 to the fan 23 so as to drive the rotation of the latter about the engine axis 9. Radially to the outside of the planet gears 32 and meshing therewith is an annulus or ring gear 38 that is coupled, via linkages 40, to a stationary supporting structure 24.

It is noted that the terms "low-pressure turbine" and "low-pressure compressor" as used herein can be taken to mean the lowest-pressure turbine stage and the lowest-pressure compressor stage (that is to say not including the fan 23) respectively and/or the turbine and compressor stages that are connected to one another by the connecting shaft 26 with the lowest rotational speed in the engine (that is to say not including the gearbox output shaft that drives the fan 23). In some literature, the "low-pressure turbine" and "low-pressure compressor" referred to herein may alternatively be known as the "intermediate-pressure turbine" and "intermediate-pressure compressor". Where such alternative nomenclature is used, the fan 23 can be referred to as a first compression stage or lowest-pressure compression stage.

Figure 3:
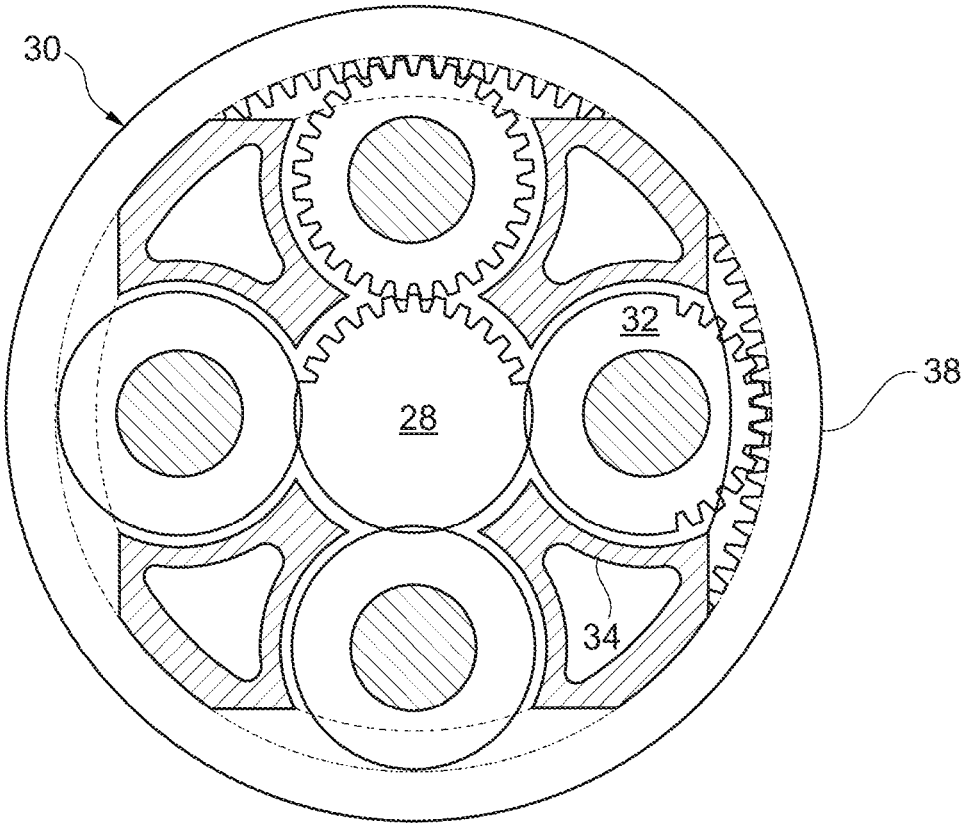
FIG. 3 shows a partially cut-away view of a gearbox for a gas turbine engine.

The epicyclic gearbox 30 is shown in an exemplary manner in greater detail in FIG. 3. Each of the sun gear 28, the planet gears 32 and the ring gear 38 comprise teeth about their periphery to mesh with the other gears. However, for clarity, only exemplary portions of the teeth are illustrated in FIG. 3. There are four planet gears 32 illustrated, although it will be apparent to the person skilled in the art that more or fewer planet gears 32 may be provided within the scope of protection of the claimed invention. Practical applications of an epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, wherein the ring gear 38 is fixed. However, any other suitable type of epicyclic gearbox 30 may be used. By way of further example, the epicyclic gearbox 30 may be a star arrangement, in which the planet carrier 34 is held so as to be fixed, wherein the ring gear (or annulus) 38 is allowed to rotate. In the case of such an arrangement, the fan 23 is driven by the ring gear 38. By way of a further alternative example, the gearbox 30 may be a differential gearbox in which the ring gear 38 and the planet carrier 34 are both allowed to rotate.

It is self-evident that the arrangement shown in FIGS. 2 and 3 is merely an example, and various alternatives fall within the scope of protection of the present disclosure. Purely by way of example, any suitable arrangement may be used for positioning the gearbox 30 in the engine 10 and/or for connecting the gearbox 30 to the engine 10. By way of further example, the connections (such as the linkages 36, 40 in the example of FIG. 2) between the gearbox 30 and other parts of the engine 10 (such as the input shaft 26, the output shaft and the fixed structure 24) may have a certain degree of stiffness or flexibility. By way of further example, any suitable arrangement of the bearings between rotating and stationary parts of the engine (for example between the input and output shafts of the gearbox and the fixed structures, such as the gearbox casing) may be used, and the disclosure is not limited to the exemplary arrangement of FIG. 2. For example, where the gearbox 30 has a star arrangement (described above), the person skilled in the art would readily understand that the arrangement of output and support linkages and bearing positions would typically be different to that shown by way of example in FIG. 2.

Accordingly, the present disclosure extends to a gas turbine engine having an arbitrary arrangement of gearbox types (for example star-shaped or planetary), support structures, input and output shaft arrangement, and bearing positions.

Optionally, the gearbox may drive additional and/or alternative components (e.g. the intermediate-pressure compressor and/or a booster compressor).

Other gas turbine engines to which the present disclosure can be applied may have alternative configurations. For example, engines of this type may have an alternative number of compressors and/or turbines and/or an alternative number of connecting shafts. By way of a further example, the gas turbine engine shown in FIG. 1 has a split flow nozzle 20, 22, which means that the flow through the bypass duct 22 has its own nozzle that is separate from and radially outside the core engine nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed-flow nozzle. One or both nozzles (whether mixed-flow or split flow) may have a fixed or variable area. Whilst the example described relates to a turbofan engine, the disclosure may be applied, for example, to any type of gas turbine engine, such as, for example, an open-rotor engine (in which the fan stage is not surrounded by an engine nacelle) or a turboprop engine. In some arrangements, the gas turbine engine 10 may not comprise a gearbox 30.

The geometry of the gas turbine engine 10 and components thereof is/are defined by a conventional axis system, comprising an axial direction (which is aligned with the axis of rotation 9), a radial direction (in the bottom-to-top direction in FIG. 1), and a circumferential direction (perpendicular to the view in FIG. 1). The axial, radial and circumferential directions are mutually perpendicular.

In the context of the present invention, the design of the blade wheels in the compressor is of importance. Here, the invention may basically be used in a low-pressure compressor, an intermediate-pressure compressor (where present) and/or a high-pressure compressor.

Figure 4:
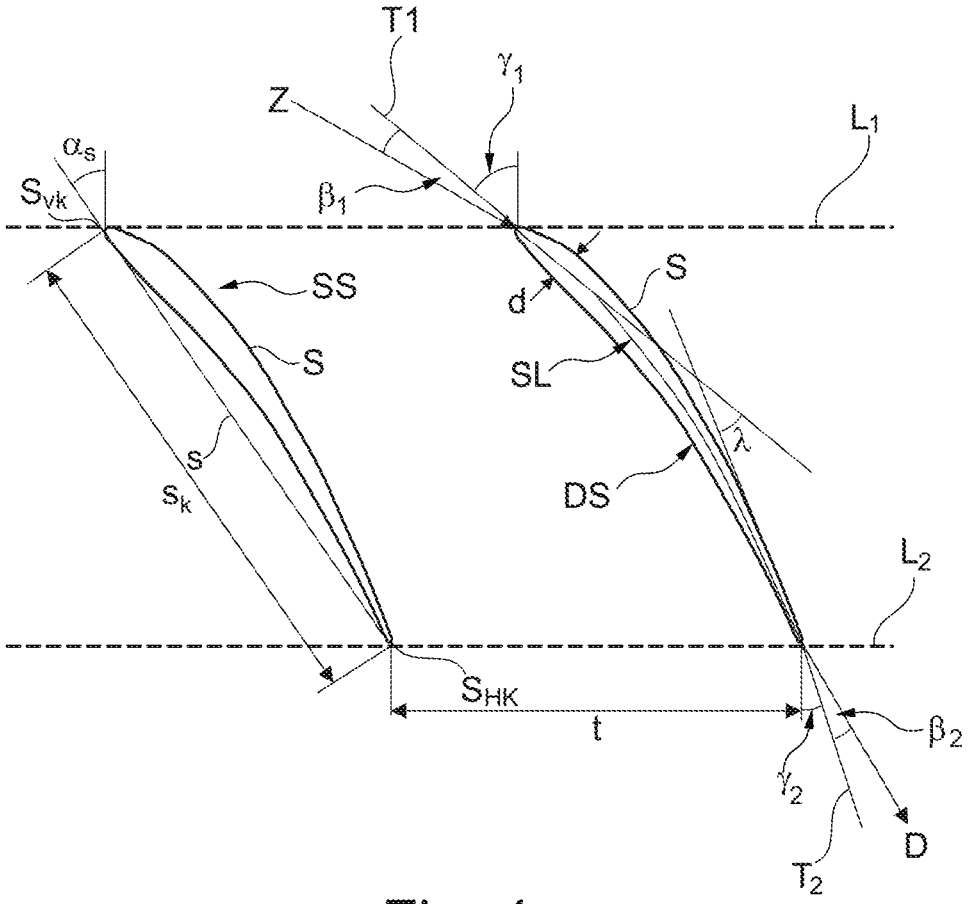
FIG. 4 shows the basic geometrical construction and the basic designations in a compressor cascade.

The basic construction of a compressor cascade will firstly be described on the basis of FIG. 4. The compressor cascade is illustrated in a conventional illustration in meridional section and in a developed view. Said compressor cascade comprises a multiplicity of blades S, which each have a leading edge $S_{VK}$ and a trailing edge $S_{HK}$. The leading edges $S_{VK}$ lie on an imaginary line $L_1$, and the trailing edges $S_{HK}$ lie on an imaginary line $L_2$. The lines $L_1$ and $L_2$ run parallel. The blades S furthermore each comprise a suction side SS and a pressure side DS. Their maximum profile thickness is denoted by d.

The compressor cascade has a cascade pitch t and a profile chord s with a profile chord length $s_k$. The profile chord s is the connecting line between the leading edge $S_{VK}$ and the trailing edge $S_{HK}$ of the profile. The blade stagger angle (hereinafter referred to as stagger angle) $\alpha_s$ is formed between the profile chord s and the perpendicular to the line $L_1$ (wherein the perpendicular at least approximately corresponds to the direction defined by the machine axis). The stagger angle $\alpha_s$ indicates the inclination of the blades S.

The blades S have a camber line SL, which is also referred to as profile centreline. This is defined by the connecting line of the circle centre points inscribed into the profile. The tangent to the camber line SL at the leading edge is denoted by $T_1$. The tangent to the camber line SL at the trailing edge is denoted by $T_2$. The angle at which the two tangents $T_1$, $T_2$ intersect is the blade camber angle $\lambda$. The inflow direction, at which the gas flows into the cascade, is denoted by Z, and the outflow direction, at which the gas flows away from the cascade, is denoted by D. The angle of incidence $\beta_1$ is defined as the angle between the tangent $T_1$ and the inflow direction Z. The deviation angle $\beta_2$ is defined as the angle between the tangent $T_2$ and the outflow direction A.

Of particular importance in the context of the present invention are the blade entry angle $\gamma_1$ and the blade exit angle $\gamma_2$. The blade exit angle $\gamma_1$ is defined as the angle between the tangent $T_1$ to the camber line SL and the perpendicular to the line $L_1$. The blade exit angle $\gamma_2$ is defined as the angle between the tangent $T_2$ to the camber line SL and the perpendicular to the line $L_2$. The blade entry angle $\gamma_1$ is also referred to as airfoil entry angle or as inflow metal angle and the blade exit angle $\gamma_2$ is also referred to as airfoil exit angle or as outflow metal angle.

The blade entry angle $\gamma_1$ and the blade exit angle $\gamma_2$ both change if the stagger angle $\alpha_s$ is changed in the case of an unchanged shape of the blades, because a change in the stagger angle $\alpha_s$ in such a situation, owing to the associated adjustment of the inclination of the blades, changes the orientation of the tangents $T_1$, $T_2$. By changing the camber of the blades S, it is however also possible for the blade entry angle $\gamma_1$ and/or the blade exit angle $\gamma_2$ to be changed without changing the stagger angle $\alpha_s$. Provision may also be made whereby, through corresponding shaping of the blades S, only the blade entry angle $\gamma_1$ or the blade exit angle $\gamma_2$ is changed, wherein this also leads to a change in the stagger angle $\alpha_s$.

FIG. 5 shows a blade wheel arrangement for a compressor, which has a first blade wheel 6 formed as a rotor. Upstream of the rotor 6, there is arranged a second blade wheel 5, which is formed as a stator. Furthermore, downstream of the rotor 6, there is arranged a third blade wheel 7, which is formed as a further stator. The stator 5 arranged upstream may be formed as an inlet stator (IGV). However, this is not necessarily the case. It may also be a normal compressor stator of a stage embedded into the compressor. A flow path 8 of the compressor or of the core engine extends through the blade wheel arrangement.

Each of these blade wheels 5, 6, 7 comprises a multiplicity of blades which extend radially in the flow path 8 of the turbomachine. Provision is made here whereby, on at least one of the blade wheels 5, 6, 7, the blades are divided into blocks, for which it is the case that the blades within a block have in each case the same blade entry angle and the same blade exit angle. By contrast, the blades of at least two mutually adjacent blocks have a different blade entry angle and/or a different blade exit angle.

This is illustrated by way of example and schematically in FIG. 6. FIG. 6 shows, in a cross section transversely with respect to the machine axis, with the polar coordinates r, φ being illustrated, a blade wheel which may be one of the blade wheels 5, 6, 7 of FIG. 5. The individual blades are not separately illustrated. The blade wheel is divided into two blocks B1, B2. Each of the blocks extends in a circumferential direction φ over an extent angle δ of 180°. Alternatively, the blade wheel may be divided into a greater number of blocks, wherein, for the extent angle δ, the following applies:

$$\delta=360°/N$$

where N denotes the number of blocks and is a natural number greater than or equal to 2. In FIG. 6, N is equal to 2.

The blades of the blocks B1, B2 have a different blade entry angle and/or a different blade exit angle.

FIG. 6 additionally shows an alternative exemplary embodiment, in which the individual blocks B1, B2 have a different extent angle in the circumferential direction. Accordingly, one block B1 has an extent angle δ1 of less than 180°, and the block B2 has an extent angle which is correspondingly greater than 180°. In further variants, the blade wheel is divided into a greater number of blocks, wherein the individual blocks each have a different extent angle and accordingly a different number of blades.

On the basis of FIGS. 7 to 9, two exemplary embodiments will be discussed, in the case of which the blade wheels form blocks with different blade entry angle and/or different blade exit angle. Here, FIG. 7 firstly shows a nominal setting of the blades, wherein all of the blades have the same blade entry angle and the same blade exit angle. Here, the illustrated blade wheel arrangement comprises a rotor 6, which has a multiplicity of rotor blades 60 which rotate in a direction F. The blades 60 of the rotor 6 form a blade row.

Upstream of the rotor 6, there is arranged a stator 5 which has a multiplicity of guide blades 50. Furthermore, downstream of the rotor 6, there is arranged a stator 7 which has a multiplicity of guide blades 70. The flow direction in which the gas flows in onto the stator 5 is denoted by the arrow E. All of the blades of the blade wheels 5, 6, 7 are formed and oriented identically in FIG. 7.

FIG. 8 shows a first exemplary embodiment of a blade wheel arrangement which differs from this. The stator 5 will firstly be considered. This has N blocks of blades, wherein blades of two blocks, specifically the blocks $B_j$ and $B_k$, are illustrated. In the illustration of FIG. 8, the individual blocks have in each case two blades. This is to be understood merely as an example. The individual blocks $B_j$ and $B_k$ may also have a greater number of blades, wherein the blades are, overall, divided into at least N=2 blocks. FIG. 8 may also be regarded as not illustrating all blades of a block, that is to say further blades of the block $B_j$ are situated adjacent above the uppermost blade in the drawing, and further blades of the block $B_k$ are situated adjacent below the lowermost blade in the drawing, wherein FIG. 8 illustrates only the transition between the two blocks $B_j$ and $B_k$.

FIG. 8 shows both the blades 50 in the nominal setting corresponding to FIG. 7 and also the blades in a setting changed in relation thereto. The blades in the changed setting are denoted by 51 in the block $B_j$ and by 52 in the block $B_k$. It is the case that the blades 51, 52 of the two blocks $B_j$ and $B_k$ have a different stagger angle. In the case of the stator 5 (the second blade wheel S2 of FIG. 5), the stagger angle is defined as follows:

$$\alpha_{S2,i}=\alpha_{S2,0}+(-1)^i\Delta\alpha_{S2}$$

Here, $\alpha_{S2,0}$ is a constant which denotes the nominal stagger angle as per FIG. 7. For i, the following applies: $1\leq i\leq N$. From the nominal setting, the stagger angle is adjusted in one direction or in the other direction by the degree of change $\Delta\alpha_{S2}$. Here, in the case of the blades of mutually adjacent blocks $B_j$ and $B_k$, the stagger angle is changed with a different sign. Thus, there a change of the stagger angle between the blades 50 and the blades 51 of the block $B_j$ by the degree of change $-\Delta\alpha_{S2}$, as indicated in FIG. 5. Between the blades 50 and the blades 52 of the block $B_k$, there is a change of the stagger angle by the degree of change $+\Delta\alpha_{S2}$. Here, the stagger angle is defined as discussed with regard to FIG. 4.

The change of the stagger angle in the individual blocks is associated with the stator blades being closed to a greater degree in the block $B_j$, and being opened to a greater degree in the block $B_k$, in relation to the nominal setting.

In the exemplary embodiment illustrated, modifications have also been made in the stagger angle in the case of the rotor 6 and in the case of the stator 7, though this is not imperative. Here, the further stator 7 will firstly be considered. This has been divided into the same number N of blocks in each case with a different stagger angle.

FIG. 8 shows both the blades 70 in the nominal setting corresponding to FIG. 7 and also the blades in a modified setting. The blades in the modified setting are denoted by 71 in the block $B_j$ and by 72 in the block $B_k$. It is the case that the blades 71, 72 of the two blocks $B_j$ and $B_k$ have a different stagger angle. In the case of the stator 7 (the third blade wheel S3 of FIG. 5), the stagger angle is defined as follows:

$$\alpha_{S3,i}=\alpha_{S3,0}-(-1)^i\Delta\alpha_{S3}$$

Here, $\alpha_{S3,0}$ is a constant which denotes the nominal stagger angle as per FIG. 7. For i, the following applies: $1\leq i\leq N$. The explanations relating to the stator 5 apply here correspondingly. Thus, there a change of the stagger angle between the blades 70 and the blades 71 of the block $B_j$ by the degree of change $+\Delta\alpha_{S3}$, as indicated in FIG. 5. Between the blades 70 and the blades 72 of the block $B_k$, there is a change of the stagger angle by the degree of change $-\Delta\alpha_{S3}$.

The change of sign in the individual blocks of the stator 7 is in this case in the opposite direction than in the case of the blocks of the stator 5. Thus, if the stator blades 51 are closed to a greater degree in the block $B_j$ of the stator 5, then the stator blades 71 are opened to a greater degree in the block $B_j$ of the stator 7. It is likewise the case that, if the stator blades 52 are opened to a greater degree in the block $B_k$ of the stator 5, the stator blades 71 in the block $B_k$ of the stator 7 are closed to a greater degree.

The degree of change $\Delta\alpha_{S3}$ may be equal to the degree of change $\Delta\alpha_{S2}$. However, this is not necessarily the case.

In FIG. 8, the blades of the rotor 6 are also divided into groups with different stagger angle. However, this is not necessarily the case. In exemplary embodiments of the invention, only the blades of the stator 5 and/or the blades of the stator 7 are divided into groups with different stagger angle. In further exemplary embodiments, provision may be made whereby only the blades of the rotor 6 are divided into groups with different stagger angle.

FIG. 8 shows both the blades 60 in the nominal setting corresponding to FIG. 7 and also the blades in a modified setting. Here, the rotor 6 is divided into the same number N of blocks of in each case different stagger angle as the stators 5, 7. The blades in the modified setting are denoted by 61 in the block $B_j$ and by 62 in the block $B_k$. It is the case that the blades 61, 62 of the two blocks $B_j$ and $B_k$ have a different stagger angle. In the case of the rotor 6 (the first blade wheel S1 of FIG. 5), the stagger angle is defined as follows:

$$\alpha_{S1,i}=\alpha_{S1,0}-(-1)^i\Delta\alpha_{S1}$$

Here, $\alpha_{S1,0}$ is a constant which denotes the nominal stagger angle as per FIG. 7. For i, the following applies: $1\leq i\leq N$. The explanations relating to the stator 5 apply correspondingly. Thus, there a change of the stagger angle between the blades 60 and the blades 61 of the block $B_j$ by the degree of change $+\Delta\alpha_{S1}$, as indicated in FIG. 5. Between the blades 60 and the blades 62 of the block $B_k$, there is a change of the stagger angle by the degree of change $-\Delta\alpha_{S1}$.

It is pointed out that, as discussed with regard to FIG. 4, a change in the stagger angle $\alpha_S$ in the case of identical shaping of the blades automatically also leads to a change in the blade entry angle and in the blade exit angle of the blades.

FIG. 9 shows a second exemplary embodiment of a blade wheel arrangement which differs from the arrangement of FIG. 7. The main difference in relation to the exemplary embodiment of FIG. 8 consists in that, in the exemplary embodiment of FIG. 9, the stagger angle (and thus, in the case of identical shaping of the individual blades, the blade entry angle and the blade exit angle) has not been changed, but rather, with different shaping of the blades of the different blocks being provided, only the blade entry angle or the blade exit angle has been changed.

The stator 5 will firstly be considered. This has N blocks of blades, wherein blades of two blocks, specifically the blocks $B_j$ and $B_k$, are illustrated. The statements relating to the size and number of the blocks with regard to FIG. 8 also apply correspondingly to FIG. 9.

FIG. 9 shows both the blades 50 in the nominal setting corresponding to FIG. 7 and also the blades in a setting changed in relation thereto. The blades with modified shaping are denoted by 53 in the block $B_j$ and by 54 in the block $B_k$. It is the case that the blades 53, 54 of the two blocks $B_j$ and $B_k$, whilst having an identical blade entry angle, have a different blade entry angle. In the case of the stator 5 (the second blade wheel S2 of FIG. 5), the blade exit angle $\gamma_2$ of the i-th block is defined as follows:

$$\gamma_{2,S2,i}=\gamma_{2,S2,0}+(-1)^i\Delta\gamma_{2,S2}$$

Here, $\gamma_{2,S2,0}$ is a constant which denotes the nominal blade exit angle as per FIG. 7. For i, the following applies: $1\leq i\leq N$. From the nominal setting, the blade exit angle is adjusted in one direction or in the other direction by the degree of change $\Delta\gamma_{2,S2}$. Here, in the case of the blades of mutually adjacent blocks $B_j$ and $B_k$, the blade exit angle is changed with a different sign. Thus, there a change of the blade exit angle between the blades 50 and the blades 53 of the block $B_j$ by the degree of change $-\Delta\gamma_{2,S2}$, as indicated in FIG. 5. Between the blades 50 and the blades 54 of the block $B_k$, there is a change of the blade exit angle by the degree of change $+\Delta\gamma_{2,S2}$. Here, the blade exit angle is defined as discussed with regard to FIG. 4.

The change of the blade exit angle in the individual blocks is associated with the stator blades being closed to a greater degree in the block $B_j$ and being opened to a greater degree in the block $B_k$.

In the exemplary embodiment illustrated, modifications have also been made in the stagger angle in the case of the rotor 6 and in the case of the stator 7, though this is not imperative. Here, the further stator 7 will firstly be considered. This has been divided into the same number N of blocks in each case with a different stagger angle.

FIG. 9 shows both the blades 70 in the nominal setting corresponding to FIG. 7 and also the blades in a modified setting. The blades with modified shaping are denoted by 73 in the block $B_j$ and by 74 in the block $B_k$. It is the case that the blades 73, 74 of the two blocks $B_j$ and $B_k$, whilst having an identical blade entry angle, have a different blade exit angle. In the case of the stator 7 (the third blade wheel S3 of FIG. 5), the blade exit angle $\gamma_2$ of the i-th block is defined as follows:

$$\gamma_{2,S3,i}=\gamma_{2,S3,0}(-1)^i\Delta\gamma_{2,S3}$$

Here, $\gamma_{2,S3,0}$ is a constant which denotes the nominal blade exit angle as per FIG. 7. For i, the following applies: $1\leq i\leq N$. From the nominal setting, the blade exit angle is adjusted in one direction or in the other direction by the degree of change $\Delta\gamma_{2,S3}$. Here, in the case of the blades of mutually adjacent blocks $B_j$ and $B_k$, the blade exit angle is changed with a different sign. Thus, there a change of the blade exit angle between the blades 70 and the blades 73 of the block $B_j$ by the degree of change $+\Delta\gamma_{2,S3}$. Between the blades 70 and the blades 74 of the block $B_k$, there is a change of the blade exit angle by the degree of change $-\Delta\gamma_{2,S3}$.

The change of sign in the individual blocks of the stator 7 is in this case in the opposite direction than in the case of the blocks of the stator 5. Thus, if the stator blades 51 are closed to a greater degree in the block $B_j$ of the stator 5, then the stator blades 71 are opened to a greater degree in the block $B_j$ of the stator 7. It is likewise the case that, if the stator blades 52 are opened to a greater degree in the block $B_k$ of the stator 5, the stator blades 71 in the block $B_k$ of the stator 7 are closed to a greater degree.

In FIG. 9, the blades of the rotor 6 are also divided into groups with different blade entry angle, wherein this is not necessarily the case. In a further design variant, too, provision may be made whereby only the blades of the rotor 6 are divided into groups with different blade entry angle.

FIG. 9 shows both the blades 60 in the nominal setting corresponding to FIG. 7 and also the blades with modified shaping. Here, the rotor 6 is divided into the same number N of blocks as the other blade wheels 5, 7. The blades with the modified shaping are denoted by 61 in the block $B_j$ and by 62 in the block $B_k$. It is the case that the blades 61, 62 of the two blocks $B_j$ and $B_k$, whilst having an identical blade exit angle, have a different blade entry angle. In the case of the rotor 6 (the first blade wheel S1 of FIG. 5), the blade entry angle $\gamma_1$ of the i-th block is defined as follows:

$$\gamma_{1,S1,i}=\gamma_{1,S1,0}+(-1)^i\Delta\gamma_{1,S1}$$

Here, $\gamma_{1,S1,0}$ is a constant which denotes the nominal blade entry angle as per FIG. 7. For i, the following applies: $1 \leq i \leq N$. From the nominal setting, the blade exit angle is adjusted in one direction or in the other direction by the degree of change $\Delta\gamma_{1,S1}$. Here, in the case of the blades of mutually adjacent blocks $B_j$ and $B_k$, the blade entry angle is changed with a different sign. Thus, there a change of the blade entry angle between the blades 60 and the blades 63 of the block $B_j$ by the degree of change $+\Delta\gamma_{1,S1}$. Between the blades 60 and the blades 64 of the block $B_k$, there is a change of the blade exit angle by the degree of change $-\Delta\gamma_{1,S1}$.

On the basis of FIGS. 11-14, a further exemplary embodiment of the invention will be described, in which the blades of a blade wheel are likewise divided into a multiplicity of blocks, wherein the blades are of identical form within a block. By contrast to the exemplary embodiments of FIGS. 4-9, however, the characteristic by which the individual blocks differ is however not the blade entry angle and/or the blade exit angle, but lies in the design of partial gaps that the blades form to the respectively adjacent flow path boundary. Here, the statements relating to FIGS. 4-9 apply correspondingly with regard to the division of the blade wheel into individual blocks.

FIG. 11 shows, in a sectional view, a structural subassembly, which defines a flow path 8 and which comprises a stator 5, a rotor 6 of a compressor stage of a compressor and flow path boundaries. The stator 5 is formed as an inlet stator, wherein this is not necessarily the case. The flow path 8 guides the core air flow A as per FIG. 1 through the core engine.

Radially on the inside, the flow path 8 is delimited by a hub 95, which forms an inner flow path boundary 950. Radially on the outside, the flow path 8 is delimited by a compressor casing 4, which forms a radially outer flow path boundary 410. The flow path 8 is formed as an annular space. The inlet stator 5 has stator blades or guide blades 55 which adjustable in terms of stagger angle and which are arranged in the flow path 8 so as to be distributed in the circumferential direction. The guide blades 55 each have a leading edge 551 and a trailing edge 552.

The swirl in the flow is increased by the inlet stator 5 and, as a result, the downstream rotor 6 is driven more effectively. The rotor 6 comprises a row of rotor blades 60, which extend radially in the flow path 8.

For adjustability of the stagger angle, the guide blades 55 are mounted so as to be rotatable. For this purpose, said guide blades are each connected rotationally conjointly to, or formed integrally with, a spindle 25. The spindle 25 has an axis of rotation, which is identical to the axis of rotation of the guide blades 55. Here, the spindle 25 is accessible and adjustable from outside the flow path 8.

Specifically, provision is made for the guide blade 55 to be connected at its radially outer end to an outer circular platform 75, which forms a rotary plate and which is connected to a radially outer spindle portion 251 of the spindle 25. The platform 75 and the spindle portion 251 are in this case mounted in a casing shroud 420, which is part of the compressor casing 4. Correspondingly, the guide blade 55 is connected at its radially inner end to an inner circular platform 78, which forms a rotary plate and which is connected to a radially inner spindle portion 252 of the spindle 25. The platform 78 and the spindle portion 252 are in this case mounted in an inner shroud 910, which locally forms the inner flow path boundary 950.

To permit rotatability the of the guide blades 55 or adjustability of the stagger angle, it is necessary for the guide blades 55 to form, in the region of their trailing edge 552 and radially adjacent to the outer flow path boundary 410 and radially adjacent to the inner flow path boundary 950, cut-backs 553, 554 which ensure that the guide blades 55, in their axially rear region, form in each case one partial gap 81 to the radially outer flow path boundary 410 and one partial gap 82 to the radially inner flow path boundary 950. This prevents, during an adjustment of the guide blade 55 by rotation about the axis of rotation, said guide blade colliding with the outer flow path boundary 410 and/or with the inner flow path boundary 950.

The gaps 81, 82 are referred to here as partial gaps because they do not extend over the entire axial length of the guide blades 55.

Provision may alternatively be made whereby the guide blades 55 are formed without a shroud at their radially inner end, for which case they end in freely floating fashion, forming a continuous gap, in a manner radially spaced apart from the inner flow path boundary 95. It may also alternatively be provided that partial gaps are formed in the region of the leading edge 51 or both in the region of the leading edge 51 and in the region of the trailing edge 52.

FIG. 12 shows the arrangement of guide blades 55, outer and inner platform 75, 78 and spindle 25 of FIG. 11 in an enlarged illustration. The cut-backs 553, 554 give rise to the partial gaps 81, 82 to the outer and inner flow path boundary respectively. Here, the partial gaps 81, 82 have a gap volume which is defined by the axial length and the radial height of the partial gaps 81, 82 or of the cut-backs 553, 554 which form said partial gaps.

For the variation of the partial gap 81 and/or of the partial gap 82 in different blocks which form the guide blades 55 of the stator 5, the radial height r of the partial gap and/or the axial length x of the partial gap may be varied. Two variations V1, V2 of the partial gaps 81, 82 are shown in FIG. 12. The first variation V1 has been implemented at the upper partial gap 81, wherein it may alternatively or simultaneously also be implemented at the lower partial gap 82. Accordingly, the radial height of the partial gap 81 has been increased by virtue of the cut-back 553' being made deeper. The second variation V2 has been implemented at the lower partial gap 82, wherein it may alternatively or simultaneously also be implemented at the upper partial gap 81. Accordingly, the axial length of the partial gap 81 has been increased by virtue of the diameter of the lower platform 78 being reduced and, at the same time, the cut-back 554 having a greater axial length.

It is also possible for the illustrated variations to be combined, that is to say the upper partial gap 81 and/or the lower partial gap 82 are varied by means of a changed axial length and a changed radial height.

Below, on the basis of FIGS. 13 and 14, two exemplary embodiments will be discussed, in the case of which the blade wheels form blocks with differently designed partial gaps. The basic arrangement corresponds here to that of FIG. 5, wherein a blade wheel arrangement for a compressor has a rotor 6, a variable stator 5 arranged upstream of the rotor 6, and a variable stator 7 arranged downstream of the rotor 6. In FIG. 13, the stator 5 arranged upstream is an inlet stator. FIG. 14 illustrates a sequence, embedded into a compressor, of stator 5, rotor 6 and stator 7.

The inlet stator 5 will firstly be considered with reference to FIG. 13. This has N blocks of blades, wherein blades of two blocks, specifically the blocks $B_j$ and $B_k$, are illustrated. In the illustration of FIG. 13, the individual blocks have in each case two blades 56, 57. This is to be understood merely as an example. The individual blocks $B_j$ and $B_k$ may also have a greater number of blades, wherein the blades are, overall, divided into at least N=2 blocks. FIG. 13 may also be regarded as not illustrating all blades of a block, that is to say further blades of the block $B_j$ are situated adjacent above the uppermost blade in the drawing, and further blades of the block $B_k$ are situated adjacent below the lowermost blade in the drawing, wherein FIG. 13 illustrates only the transition between the two blocks $B_j$ and $B_k$.

The blocks $B_j$ and $B_k$ differ by the partial gaps that the blades 56, 57 form in relation to the adjacent flow path boundary. Accordingly, the partial gaps 811 of the blades 56 of the block $B_j$ of the inlet stator 5 have greater axial extent than the partial gaps 812 of the blades 57 of the block $B_k$. The gap area covered by the partial gaps 811 is accordingly larger than the gap area covered by the partial gaps 812.

In the exemplary embodiment illustrated, modifications have also been made in the partial gaps in the case of the stator 7, though this is not imperative. Said stator has been divided into the same number N of blocks $B_j$ and $B_k$ with in each case differently formed partial gaps to the outer flow path boundary and/or to the inner flow path boundary. Alternatively, modifications are realized in the partial gaps only in the case of the stator 7.

The partial gaps 813 of the blades 76 of the block $B_j$ of the stator 7 have smaller axial extent than the partial gaps 814 of the blades 77 of the block $B_k$. The gap area covered by the partial gaps 813 is accordingly smaller than the gap area covered by the partial gaps 814. The assignment of the partial gaps between the blocks of the inlet stator 5 and the blocks of the stator 7 is in this case offset, that is to say blocks with relatively large partial gaps 811 of the inlet stator 5 are assigned blocks 813 with relatively small partial gaps 813 of the stator 7, and vice versa.

Here, in FIG. 13 and in FIG. 14, the section of the illustration lies directly adjacent to the radially outer flow path boundary 410. Partial gaps are thus formed in the regions 811, 812, 813, 814. Correspondingly, partial gaps may additionally be formed adjacent to the radially inner flow path boundary 950 or only adjacent to the radially inner flow path boundary 950, see FIG. 11.

It is furthermore pointed out that the partial gaps 811, 812, 813, 814 may additionally also have a radial variation, as illustrated schematically in FIG. 12. Such a radial variation cannot be seen in the sectional illustration of FIGS. 13 and 14.

A further variation may consist in the partial gaps being realized not in the region of the trailing edge of the blades but in the region of the leading edge of the blades, or both in the region of the trailing edge and in the region of the leading edge of the blades.

FIG. 14 shows, in the blade profile, a blade wheel arrangement which comprises two variable stators 5, 7, and a rotor 6 arranged in between, embedded into a compressor.

The inlet stator 5 has N blocks of blades, wherein blades of two blocks, specifically the blocks $B_j$ and $B_k$, are illustrated. In the illustration of FIG. 14, the individual blocks have in each case two blades 58, 59. With regard to the size of the individual blocks $B_j$ and $B_k$, the statements relating to FIG. 13 apply correspondingly. The blocks $B_j$ and $B_k$ differ by the partial gaps that the blades 58, 59 form in relation to the adjacent flow path boundary. Accordingly, the partial gaps 815 of the blades 58 of the block $B_j$ of the stator 5 have smaller axial extent than the partial gaps 816 of the blades 59 of the adjacent block $B_k$. The gap area covered by the partial gaps 815 is accordingly smaller than the gap area covered by the partial gaps 816.

In the exemplary embodiment illustrated, modifications have also been made in the partial gaps in the case of the stator 7, though this is not imperative. Said stator has been divided into the same number N of blocks $B_j$ and $B_k$ with in each case differently formed partial gaps to the outer flow path boundary and/or to the inner flow path boundary. Alternatively, modifications are realized in the partial gaps only in the case of the stator 7.

Here, the stator 7 is formed in the same way as the stator 7 of FIG. 13. The partial gaps 813 of the blades 76 of the block $B_j$ of the stator 7 have smaller axial extent than the partial gaps 814 of the blades 77 of the block $B_k$. The gap area covered by the partial gaps 813 is accordingly smaller than the gap area covered by the partial gaps 814. The assignment of the partial gaps between the blocks of the inlet stator 5 and the blocks of the stator 7 is in this case such that blocks with relatively small partial gaps 815 of the stator 5 are assigned blocks 813 with relatively small partial gaps 813 of the stator 7, and blocks with relatively large partial gaps 816 of the stator 5 are assigned blocks with relatively large partial gaps 814 of the stator 7.

The variants discussed with regard to the exemplary embodiment of FIG. 13 also apply correspondingly to the exemplary embodiment of FIG. 14.

It is also pointed out that the design embodiments of FIGS. 11-14 may be combined with the design embodiments of FIGS. 3-9. The individual blocks of blades that form a blade wheel may thus differ both with regard to the blade entry angle and/or blade exit angle and/or the stagger angle and with regard to the design embodiment of the partial gaps.

FIG. 10 schematically shows the advantages attained by means of the present invention. The aerodynamic damping is plotted versus the nodal diameter. Here, it is firstly to be noted that the blade rows form cyclic overall modes of oscillation which are characterized by nodal lines. Here, the maximum number of nodal lines is equal to half of the blades in the case of an even number of blades, and is equal to half of the blades minus one in the case of an odd number of blades. In a nodal line, the deflection is equal to zero.

The nodal diameter is defined by the nodal pattern. In FIG. 10, the bar X1 shows oscillation excitations without implementation of the invention, and the bar X2 shows oscillation excitations with implementation of the invention. By means of the invention, a different nodal pattern has been generated, in the case of which the aerodynamic damping is increased, such that the build-up of rotating separation is prevented in an effective manner.

It is self-evident that the invention is not limited to the embodiments described above and that various modifications and improvements may be made without departing from the concepts described herein. For example, provision may be made whereby the individual blocks realize more than two different blade entry angles and/or blade exit angles, that is to say for example a total of 6 blocks are provided, of which two have a first blade entry angle and/or blade exit angle, two further have a second blade entry angle and/or blade exit angle, and two further have a third blade entry angle and/or blade exit angle. Here, in further exemplary embodiments, provision may be made whereby the blade entry angle and/or blade exit angle changes not in discrete fashion but in continuous fashion between adjacent blocks, for example in accordance with the shape of a sinusoidal curve.

It is also pointed out that, in the case of a discrete change, an identical deviation, which differs only in terms of the sign, of the respectively considered angle from the nominal setting is to be understood merely as an example. Provision may alternatively be made whereby the change in angle in one direction does not imperatively correspond to the change in angle in the other direction.

It is pointed out that any of the features described may be used separately or in combination with any other features, unless they are mutually exclusive. The disclosure also extends to and comprises all combinations and sub-combinations of one or a plurality of features which are described here. If ranges are defined, said ranges thus comprise all of the values within said ranges as well as all of the partial ranges that lie in a range.

The invention claimed is:

1. A blade wheel of a turbomachine, comprising:

a plurality of blades which are suitable and provided for extending radially in a flow path of the turbomachine, wherein the blade wheel includes N blocks of blades, where N≥2, wherein:

the blades of each of the blocks has a same blade entry angle and a same blade exit angle, and the blades of at least two mutually adjacent blocks have at least one chosen from a different blade entry angle and a different blade exit angle;

wherein for an angular position of the blades of at least one of the blocks, the following applies:

$$\varphi_l = \varphi_0 + \sum_{k=1}^{N} a_k \cos\left(\frac{2k\pi}{N} l\right) + b_k \sin\left(\frac{2k\pi}{N} l\right)$$

where:

φ is the blade entry angle, the blade exit angle or a stager anal of the blades;

$a_k$, $b_k$ are freely selectable coefficients in a range of −10° to 10°;

the index "l" denotes a number of the block under consideration;

the index "k" denotes a running index of the coefficients, where k=1 to N;

$\varphi_0$ is the mean angle that is set; and wherein, for at least two values of the index "k", not both coefficients $a_k$, $b_k$ are equal to zero.

2. The blade wheel according to claim 1, wherein the blades of the at least two mutually adjacent blocks have the at least one chosen from the different blade entry angle and the different blade exit angle because, where the blades are identically shaped, the blades form a different stagger angle.

3. The blade wheel according to claim 1, wherein the blades of the at least two mutually adjacent blocks have the at least one chosen from the different blade entry angle and the different blade exit angle because the blades have a different shape.

4. The blade wheel according to claim 1, wherein at least two of the blocks have a different extent angle in a circumferential direction, wherein the blocks with the different extent angle have a different number of blades.

5. The blade wheel according to claim 1, wherein the blades of one of the blocks are opened in relation to a nominal blade setting and the blades of an adjacent one of the blocks are closed in relation to the nominal blade setting.

6. A blade wheel arrangement for a compressor of a turbomachine, comprising:

a first blade wheel, which is formed as a rotor, a second blade wheel, which is arranged upstream of the first blade wheel and which is formed as a stator, and a third blade wheel, which is arranged downstream of the first blade wheel and which is formed as a stator, wherein at least one chosen from the first, second and third dale wheels is the blade wheel according to claim 1.

7. The blade wheel arrangement according to claim 6, wherein the second blade wheel and the third blade wheel form the same number of N blocks of blades.

8. The blade wheel arrangement according to claim 7, wherein a block of the second blade wheel, in which the blades of the block are closed to a greater degree in relation to a nominal blade setting, is assigned a block of the third blade wheel, in which the blades of the block are opened to a greater degree in relation to a nominal blade setting.

* * * * *